US006450615B2

(12) United States Patent
Kojima et al.

(10) Patent No.: US 6,450,615 B2
(45) **Date of Patent: *Sep. 17, 2002**

(54) INK JET PRINTING APPARATUS AND METHOD USING A PRESSURE GENERATING DEVICE TO INDUCE SURFACE WAVES IN AN INK MENISCUS

(75) Inventors: Ryuichi Kojima; Yasuhiro Otsuka; Torahiko Kanda; Fuminori Takizawa; Masakazu Okuda; Hirofumi Nakamura, all of Tokyo (JP)

(73) Assignee: NEC Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/026,335

(22) Filed: Feb. 19, 1998

(30) Foreign Application Priority Data

| | | |
|---|---|---|
| Feb. 19, 1997 | (JP) | 9-035279 |
| Feb. 19, 1997 | (JP) | 9-035284 |
| Feb. 19, 1997 | (JP) | 9-035309 |
| Feb. 19, 1997 | (JP) | 9-035317 |

(51) Int. Cl.[7] ..... B41J 2/135
(52) U.S. Cl. ..... 347/46
(58) Field of Search ..... 347/20, 44, 47, 347/46

(56) References Cited

U.S. PATENT DOCUMENTS

| | | | | |
|---|---|---|---|---|
| 3,211,088 A | | 10/1965 | Naiman | |
| 3,946,398 A | | 3/1976 | Kyser et al. | |
| 4,380,018 A | | 4/1983 | Andoh et al. | |
| 4,734,706 A | * | 3/1988 | Le et al. | 347/44 |
| 5,194,880 A | | 3/1993 | Elrod et al. | |
| 5,216,451 A | | 6/1993 | Rawson et al. | |
| 5,277,754 A | * | 1/1994 | Hadimioglu et al. | 156/644 |
| 5,305,016 A | | 4/1994 | Quate | |
| 5,406,318 A | * | 4/1995 | Moore et al. | 347/70 |
| 5,415,679 A | | 5/1995 | Wallace | |
| 5,495,270 A | * | 2/1996 | Burr et al. | 347/10 |
| 5,591,490 A | * | 1/1997 | Quate | 427/457 |
| 5,821,958 A | | 10/1998 | Lim | |

FOREIGN PATENT DOCUMENTS

| | | |
|---|---|---|
| DE | 198 03 467 | 8/1998 |
| EP | 0 243 118 | 10/1987 |
| EP | 0 418 659 A2 | 3/1991 |
| EP | 0 513 441 A1 | 11/1992 |
| EP | 0 549 244 A1 | 6/1993 |
| EP | 0 787 589 | 6/1997 |

(List continued on next page.)

*Primary Examiner*—John Barlow
*Assistant Examiner*—Michael S Brooke
(74) *Attorney, Agent, or Firm*—Sughrue Mion, PLLC

(57) ABSTRACT

Characteristics of a droplet ejection apparatus are change depending on the shape or cone angle of the main ink ejection chamber of the apparatus, or on the diameter of the ejection aperture of main ink ejection chamber. Accordingly, operation of the droplet ejection apparatus varies with the shape, angle, or diameter of main ink ejection chamber. The shape of the aperture according to the present invention is circular or regular polygonal so that surface waves are synthesized at the central portion of the ejection aperture. Moreover, the cone angle of the main chamber is set to 65° or less from the plane vertical to the droplet ejecting direction and the diameter of the ejection aperture is set to a value 1.25 times or more larger than a desired droplet diameter.

12 Claims, 21 Drawing Sheets

FOREIGN PATENT DOCUMENTS

| | | |
|---|---|---|
| GB | 2 220 618 A | 1/1990 |
| GB | 2 302 842 | 5/1997 |
| JP | 57-176172 | 10/1982 |
| JP | 61-59911 | 12/1986 |
| JP | 63005949 | 1/1988 |
| JP | 63-162253 | 7/1988 |
| JP | 1-74141 | 5/1989 |
| JP | 1-196350 | 8/1989 |
| JP | 3-155948 | 7/1991 |
| JP | 4-14455 | 1/1992 |
| JP | 4-21450 | 1/1992 |
| JP | 4-33862 | 2/1992 |
| JP | 4-148938 | 5/1992 |
| JP | 4-168050 | 6/1992 |
| JP | 4-299148 | 10/1992 |
| JP | 5-38810 | 2/1993 |
| JP | 6-115069 | 4/1994 |
| JP | 6-238884 | 8/1994 |
| JP | 7-8562 | 2/1995 |
| JP | 3-314664 | 12/1995 |
| JP | 8-290587 | 11/1996 |
| JP | 09-57963 B41 J | 3/1997 |

* cited by examiner

INK JET PRINTING APPARATUS AND METHOD USING A PRESSURE GENERATING DEVICE TO INDUCE SURFACE WAVES IN AN INK MENISCUS

BACKGROUND OF THE INVENTION

1. Field of the Invention

Though the present invention is an apparatus developed for an ink-jet recording head, it can be widely used as an apparatus for forming a conductive film of a small electric circuit or integrated circuit and moreover, performing fine printing in addition to the ink-jet recording head. The present invention relates to the improvement of the art disclosed in Japanese Patent Application Laid-open No. 57963/1997 (hereafter referred to as "older application") previously applied by the present applicant.

2. Description of the Related Art

The present applicant disclosed a droplet ejection apparatus according to a new theory in the above older application. The droplet ejection apparatus comprises an main chamber having an inlet and an ejection aperture and pressurizing means for applying a pressure to the liquid introduced into the main chamber. The ejection aperture forms surface waves on the surface of the injection liquid contacting the air at the ejection aperture by the pressure and ejects droplets having a diameter smaller than that of the ejection aperture in accordance with the action of the surface waves. To form surface waves on the surface of the liquid at the ejection aperture, the sectional shape illustrated in FIG. 40 is disclosed. FIG. 40 is an illustration showing the structure of a ink droplet ejection apparatus. The droplet ejection apparatus is provided with an inlet 1, an ejection aperture 2, a vibration plate 3, a piezoelectric actuator 4, an main chamber 5, and an ink supply 6.

When providing a mechanical displacement for the vibration plate 3 driven by the piezoelectric actuator 4, the pressure of the ink stored in the main chamber 5 changes and surface waves are produced on the surface of the ink at the ejection aperture 2. The surface waves move from the circumference of the ejection aperture 2 to the central portion, interfere with each other at the central portion to increase their wave height, and resultingly droplets of the ink separate from the surface of the ink. The ink is fed to the injection chamber 5 from the ink supply 6 after passing through the inlet 1.

The above phenomenon is conceptually described below. When dropping a drop of water onto a stationary water surface, an annular surface wave expands centering about the drop-of-water fall point. A phenomenon just reverse to the above phenomenon occurs on the ink surface at the injection aperture 2 of the present invention. When producing surface waves bound for the center of the ejection aperture 2 from the circumference of the aperture 2, the waves concentrate on the center of the ejection aperture 2 and ink droplets separate from the ink surface.

FIG. 41 is a structural drawing for explaining the aperture portion of a printing apparatus provided with a plurality of ink droplet ejection apparatuses. As shown in FIG. 41, by arranging a plurality of ejection apertures 2 of droplet ejection apparatuses $\mathbf{14}_1$ to $\mathbf{14}_n$ and controlling the ink ejection of each ejection aperture 2, it is possible to print the paper passing through the front of the ejection aperture ? in the direction of the arrow. Thereby, it is possible to constitute the head of the printing apparatus.

An apparatus according to the new theory makes it possible to eject a droplet having a diameter smaller than that of an ejection aperture. Therefore, even if an ejection aperture having a large diameter is formed by roughly setting a machining accuracy, it is possible to perform high-resolution printing by ejecting small droplets. That is, it is possible to provide a high-resolution apparatus inexpensively and easily. Moreover, because it is possible to increase the diameter of an ejection aperture, clogging with ink does not easily occur, and an apparatus has a high adaptability to the surrounding environmental change. That is, available temperature range and humidity range are expanded. Moreover, there are superior features including the fact that requirements to the composition of a liquid are moderated and thereby, the liquid can be adapted to various types of inks.

The inventor of the present application et al. performed various tests on the droplet injection apparatus according to the new theory. Then, they confirmed through the tests that the droplet ejection apparatus according to the theory was considerably effective. As the standard of a practical printing apparatus, at least a resolution of approx. 300 dpi (dots per inch) or higher is required to print beautiful Japanese characters. In the case of the present invention, study has been progressed by aiming at the development of a practical printing apparatus having a resolution of 300 dpi or higher.

In this case, the most important problem to obtain a practical apparatus is to form surface waves on the surface of an ejection aperture instead of directly discharging an injection liquid from the ejection aperture. Moreover, another important problem is how to constantly stably form the surface waves under environmental conditions including practical temperature and humidity. To solve the problems, it is necessary to consider the following factors: (1) mechanical structures or shape of main chambers and aperture, (2) viscosity, surface tension, density, and other physical properties of liquid, and (3) art for controlling pressure to be applied to main chamber.

SUMMARY OF THE INVENTION

The first invention discloses a condition obtained as the result of performing many tests on the above Item (1) and apparatus structure according to the condition. It is an object of this invention to provide a compact, simple, and high-resolution droplet ejection apparatus. It is another object of this invention to provide a practical printing apparatus having a resolution of 300 dpi or higher. It is still another object of this invention to provide a droplet ejection apparatus which can be widely used as an apparatus for forming a conductive film of a small electric circuit or integrated circuit and moreover performing fine printing.

The second invention discloses a condition obtained as the result of performing many tests on the above Item (2) and an apparatus structure according to the condition.

It is an object of the second invention to provide an apparatus less influencing a liquid and capable of performing stable ejection even if the operating environmental temperatures of the apparatus are changed.

The third and the fourth inventions disclose a condition obtained as the result of performing many tests on the above Item (3) and an apparatus structure according to the condition.

The first invention is a droplet ejection apparatus comprising an chamber having an ejection aperture and pressuring means for applying a pressure to the liquid introduced into the chamber, in which the chamber is formed into a shape for forming surface waves on the surface of the liquid at the ejection aperture with the pressure and ejecting droplets having a diameter smaller than the diameter of the ejection aperture and whose sectional size vertical to the ejecting direction is decreased toward the ejection aperture, wherein the cross section of the chamber vertical to the injecting direction is circular or regular polygonal.

The first invention is characterized by forming the planar sectional shape of the chamber to be circular or regular polygonal. That is, for surface waves to be synthesized at the central potion of an ejection aperture, a circle or regular polygon is suitable for the shape of the ejection aperture. Because the ejection aperture is formed at an end of the wall surface of the chamber, it is proper to form the planar sectional shape of the chamber to be circular or regular polygonal.

It is preferable that the angle θ formed between the wall surface and a plane vertical to the ejecting direction (see FIG. 1) is set to 65° or less and the diameter D of the ejection aperture is set to a value 1.25 or more times larger than a desirable diameter of droplets to be injected from the ejection aperture. According to the results of tests, it is more preferable that the angle θ is set to 60° or less and 15° or more.

The present inventor et al. could obtain the optimum values of the angle θ and the diameter D to develop a practical apparatus for the droplet ejection apparatus of the older application. In general, the ink used for a droplet ejection apparatus has a viscosity of 1.5 to 5 cP in the case of a water-based ink, a viscosity of 8 to 15 cP in the case of an oil-based ink, and a viscosity of 8 to 15 cP in the case of a hot-melt ink. The surface tension ranges between 10 and 70 dyne/cm in any case. As the result of performing ejection experiments by using the above various types of inks, it is found that the angle θ increases and it is impossible to form surface waves on the free surface of a liquid over 65°, that is, the liquid protrudes cylindrically. Moreover, it is found that, by decreasing the angle θ, it is possible to form surface waves at the ejection aperture. As the result of performing more minute examination, it is found that the phenomenon in which a liquid cylindrically protrudes hardly occurs by setting the angle θ to a value smaller than 60°0. That is, it is found that most of the pressure applied to the liquid is used to form surface waves and concentric preferable surface waves are efficiently formed by setting the angle θ to a value smaller than 60°. The lower limit of the angle θ is determined by the fact that strength or stiffness is decreased due to decrease of the wall thickness nearby an aperture in addition to the problems on the machining including the volume of an chamber and the relation with an adjacent ink supply. From the viewpoint of a practical structure, the lower limit is an angle θ of approx. 15°.

Moreover, it is found that the diameter D requires a value 1.25 or more times larger than a desired diameter of a droplet to be ejected in order to eject droplets by making surface waves interfere each other. That is, if the diameter D is smaller than the above value, formed surface waves are held together due to the surface tension and thereby, it is impossible to form preferable surface waves. However, when the diameter D is larger than the above value, preferable surface waves are formed. Further, increasing the above value reduces the cost for machining an ejection aperture. However, by increasing the above value, it is necessary to consider that the distance from an adjacent ejection aperture is restricted, more amount of ink is evaporated, and formed surface waves are attenuated when they propagate on the surface. In the case of a practical structure, the upper limit of the above value is a value approx. three times larger than a desired maximum diameter of a droplet to be ejected.

If the wall surface of the chamber is displaced due to the applied pressure, formation of surface waves is rendered weak. That is, when decreasing the angle θ of the wall surface in the chamber to less than 60°, most of the pressure applied to the liquid is used to form surface waves and surface waves are efficiently formed. However, because the wall thickness nearby the injection aperture decreases, the strength and stiffness of the wall surface are decreased. When the stiffness decreases, the vicinity of the edge of the ejection aperture is vertically displaced due to droplet ejection and a problem occurs that the surface-wave formation efficiency lowers or liquid injection becomes unstable.

Therefore, by forming the wall surface of the chamber like a knife edge, it is possible to increase the stiffness of the wall surface of the chamber. That is, it is possible to form the wall surface of the chamber so as to be flared forward the outside of the chamber from the middle though the wall surface slowly narrows toward the ejection aperture. In this case, the substantial ejection aperture is a portion where the diameter of the chamber is minimized.

Moreover, it is effective to set a reinforcing member for preventing the wall surface from being displaced due to the pressure applied to the injection chamber around the injection aperture. According to this structure, the wall surface of the injection chamber is not displaced due to the pressure and therefore, it is possible to effectively form surface waves. In this case, it is possible to form the aperture of the reinforcing member into any shape as long as the shape does not interrupt the formation of surface waves on the liquid level or the liquid ejection through the ejection aperture. The diameter of the aperture of the reinforcing member can be smaller than that of the ejection aperture as long as a droplet smaller than the diameter of the ejection aperture can effectively pass through the aperture of the member.

The second invention is a droplet ejection apparatus comprising an chamber having an injection aperture and pressuring means for applying a pressure to the liquid introduced into said chamber, in which the chamber is formed into a shape for forming surface waves on the surface of the liquid at the ejection aperture with the pressure and ejecting droplets having a diameter smaller than the diameter of the ejection aperture, and means for heating said liquid is included.

The second invention is characterized by including means for heating the injection liquid.

It is preferable that the heating means includes means for controlling the temperature of the liquid almost constantly. Moreover, it is preferable that the heating means is set so that the temperature of the liquid becomes higher than the practical maximum temperature of an apparatus.

It is possible to constitute a structure provided with an electric heater for heating the wall surface of the chamber. That is, it is also possible to constitute a structure in which the wall surface is made of a heat conducting member and a heater element contacting the heat conducting member is included or a structure in which the wall surface is constituted with an electric exothermic body.

Moreover, it is possible to constitute a structure in which an electric exothermic body is formed on the contact surface of the pressurizing means with the liquid.

Furthermore, it is possible to constitute a structure in which the heating means heats a head including a plurality of the chambers and a plurality of the pressurizing means.

To develop a practical apparatus for the droplet ejection apparatus of the older application, the present inventor et al. noticed that ejection characteristics were changed depending on the physical properties such as the surface tension and viscosity of a liquid. They confirmed that a liquid having lower viscosity and larger surface tension easily formed very small droplets and the speed of droplets to be ejected (hereafter referred to as droplet speed) could be increased. In general, a liquid changes in viscosity and surface tension depending on temperature. Therefore, it is found that droplets are stably ejected at desired droplet diameter and droplet speed by controlling the temperature of the liquid. Moreover, it is found that, even with changes in the environmental temperatures, stable droplet discharge can be maintained by controlling the temperature of the liquid.

The third invention is a droplet injection apparatus comprising an injection chamber having an ejection aperture and pressuring means for applying a pressure to the liquid introduced into the chamber, in which the chamber is formed into a shape for forming surface waves on the surface of the liquid at the ejection aperture with the pressure and droplets having a diameter smaller than the diameter of the ejection aperture, and a pulse to be applied to the pressurizing means is a single pulse having a pulse width "t" of 100 $\mu$S or less.

The third invention is characterized by using a single pulse having a pulse width "t" of 100 $\mu$S or less as the pulse to be applied to the pressurizing means when the diameter of the injection aperture is 1.25 or more times larger than a desired droplet diameter. According to the results of tests, it is preferable that the pulse width "t" is 50 $\mu$S or less. The pulse width "t" can be set to various values. In this case, a pulse width is equivalent to the time until returning the liquid in the chamber after pressurizing it.

To develop a practical apparatus for the droplet ejection apparatus according the new theory disclosed in the older application, the present inventor et al. performed various tests on the value of the pulse width "t" to be applied to pressurizing means. That is, as described above, an ideal dot diameter on a printing medium at a desired resolution of 300 dpi requires approx. square root of 2 times valve larger than a dot pitch and this value corresponds to approx. 120 $\mu$m. Moreover, it is possible to experientially recognize that the relation between dot diameter and droplet diameter on a chart depends on the characteristic of a printing medium or the speed of an ejected droplet. Moreover, it is experimentally found that the speed of an ejected droplet cannot greatly be changed in accordance with the composition of a liquid as long as following the new theory. That is, it is found that, by forming surface waves so as to separate droplets from the liquid surface, the speed of the ejected droplets becomes a nearly constant value (e.g. approx. 3 to 10 m/S when heating a typing ink used for experiments to a temperature approx. 30° C. higher than room temperature) and the practical speed of the ejected droplets becomes approx. 4 m/S even if changing the energy to be applied to pressurizing means or using an ejection aperture having a different diameter. To form a printing dot having a diameter of 120 $\mu$m on coated paper under the above condition, it is necessary to eject a droplet having a diameter of approx. 60 to 70 $\mu$m. It was observed how droplet diameters changed by changing the pulse width "t" to be applied to pressurizing means in order to discharge an ink droplet having a diameter of approx. 60 to 70 $\mu$m. As a result, it is found that an almost desired droplet diameter is obtained by setting the pulse width "t" to 100 $\mu$S or less and moreover, it is found that it is more preferable to set the pulse width "t" to 50 $\mu$S or less.

It is possible to set the pulse width "t" to various values. Thereby, it is possible to correspond to the temperature of ink and moreover, the change of environmental conditions and change practical droplet diameters by changing the pulse width "t".

The fourth invention is a droplet ejection apparatus comprising an chamber having an ejection aperture and pressuring means for applying a pressure to the liquid introduced into the chamber, in which the chamber is formed into a shape for forming surface waves on the surface of the injection liquid at the injection aperture with the pressure and ejecting droplets having a diameter smaller than the diameter of the ejection aperture, the pressurizing means is provided with an electric-signal generation circuit and an piezoelectric actuator which is driven by an output of the electric-signal generation circuit and whose mechanical-displacement output is applied to the liquid in the chamber, and a filter circuit for selectively passing a frequency component suited to form the surface waves is connected to a circuit between the output of the electric-signal generation circuit and the piezoelectric actuator.

The fourth invention is characterized in that the pressurizing means is provided with an electric-signal generation circuit and a piezoelectric actuator which is driven by the output of the electric-signal generation circuit and whose mechanical displacement output is applied to the liquid in the chamber and a filter circuit for selectively passing frequency components suited to form the . surface waves is set in the circuit between the output of the electric-signal generation circuit and the piezoelectric actuator. It is preferable that the frequency components are sine-wave pulses.

In this case, a sine-wave pulse is defined as a pulse waveform having a very narrow frequency distribution included in a pulse signal.

It is preferable that the electric-signal generation circuit is a pulse generation circuit for generating a triangular pulse, rectangular pulse, or trapezoidal pulse and the filter circuit uses a low-pass filter. The low-pass filter can be realized by, for example, a CR filter.

To develop a practical apparatus for the droplet injection apparatus of the older application, the present inventor et al. noticed that a sine-wave pulse was most suitable for a waveform for pressurizing the ink in an injection chamber. The above fact was obtained by experimentally confirming that it was possible to make surface waves with arranged phases interfere each other at the center and perform the most stable discharge on droplet diameter and droplet-speed because the frequency component of a sine-wave pulse was single.

Therefore, they attempted to directly generate a sine-wave pulse by an electric-signal generation circuit. However, it is found that a synthesizer circuit or the like is necessary to generate a single sine-wave pulse and the cost increased. Therefore, it is found that a waveform close to a sine-wave pulse which is a basic wave can be obtained by generating a proper triangular, rectangular, or trapezoidal pulse by the electric-signal generation circuit and passing the pulse through a filter circuit comprising a low-pass filter instead of directly generating the sine-wave pulse. Thereby, it becomes possible to constitute the practical apparatus with simple and inexpensive circuits compared to the case of directly generating a sine-wave pulse by the electric-signal generation circuit.

DESCRIPTION OF THE PREFERRED EMBODIMENT

Figure 1:
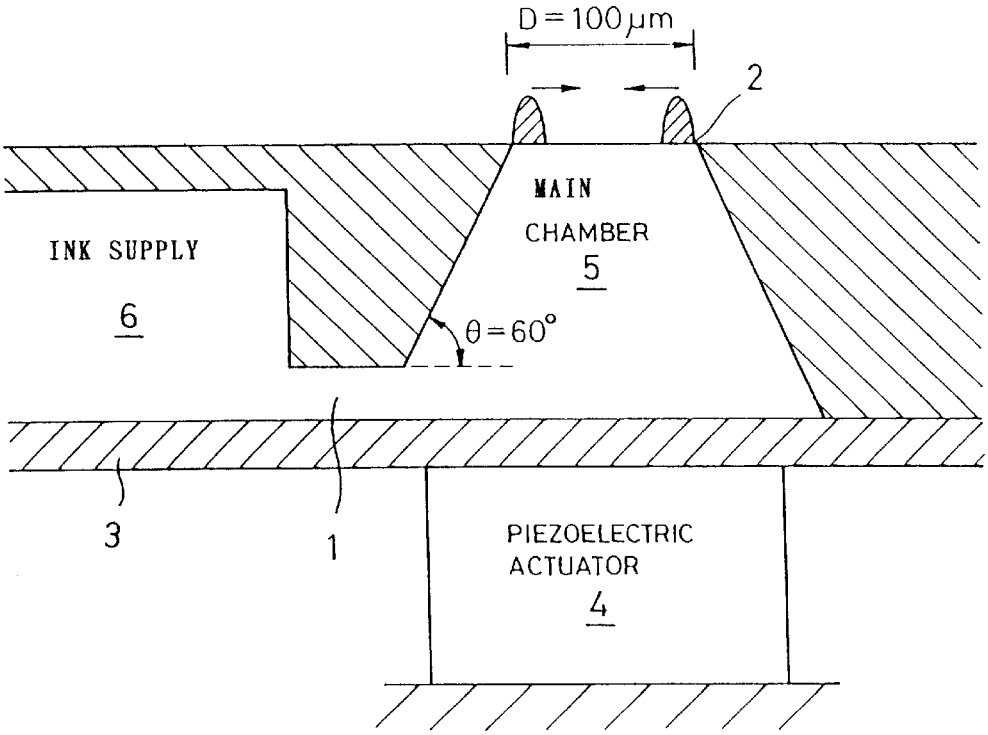
FIG. 1 is a schematic diagram of the apparatus of the first embodiment of the first invention.

The structure of the first embodiment of the first invention is described below by referring to FIG. 1.

The first invention is a droplet ejection apparatus provided with an main chamber 5 having an inlet 1 and an ejection aperture 2 and a vibration plate 3 serving as pressurizing means for applying a pressure to the liquid, for example, ink, introduced into the main chamber 5, in which the ejection aperture 2 is formed into a shape for forming surface waves on the surface of the liquid at the ejection. aperture 2 due to the pressure and ejecting droplets having a diameter smaller than that of the ejection aperture 2.

In this case, the first invention is characterized in that the ejection chamber 5 is provided with a wall surface whose diameter decreases toward the ejection aperture 2 and whose planar sectional shape vertical to the ejecting direction is circular or regular-polygonal.

The angle θ formed between the wall surface and the plane vertical to the ejecting direction is set to 65° or less and the diameter D of the ejection aperture 2 is set to a value 1.25 or more times larger than a desired diameter of a droplet ejected from the enjection aperture 2.

In the case of the droplet ejection apparatus shown in FIG. 1, the desired droplet diameter is set to approx. 70 μm and the diameter D of the ejection aperture 2 is set to 100 μm. Moreover, the angle θ formed between the wall surface of the ejection chamber 5 and the plane vertical to the droplet ejecting direction is set to 60°. By setting the diameter of a droplet to approx. 70 μm and the droplet speed to 4 m/sec, it is generally possible to form a dot having a diameter of 120 μm on coated paper. Thereby, it is possible to obtain a resolution of approx. 300 dpi (dots per inch).

The following is the reason why the planar sectional shape of the main chamber 5 is made to be circular or regular polygonal. For surface waves to be synthesized at the central portion of the ejection aperture 2, it is self-evident that a circle or regular polygon is suitable for the shape of the ejection aperture 2. Because the ejection aperture 2 is formed at an end of the main chamber 5, it is found that it is also proper to form the planar sectional shape of the main chamber 5 to be circular or regular polygonal.

Figure 2:
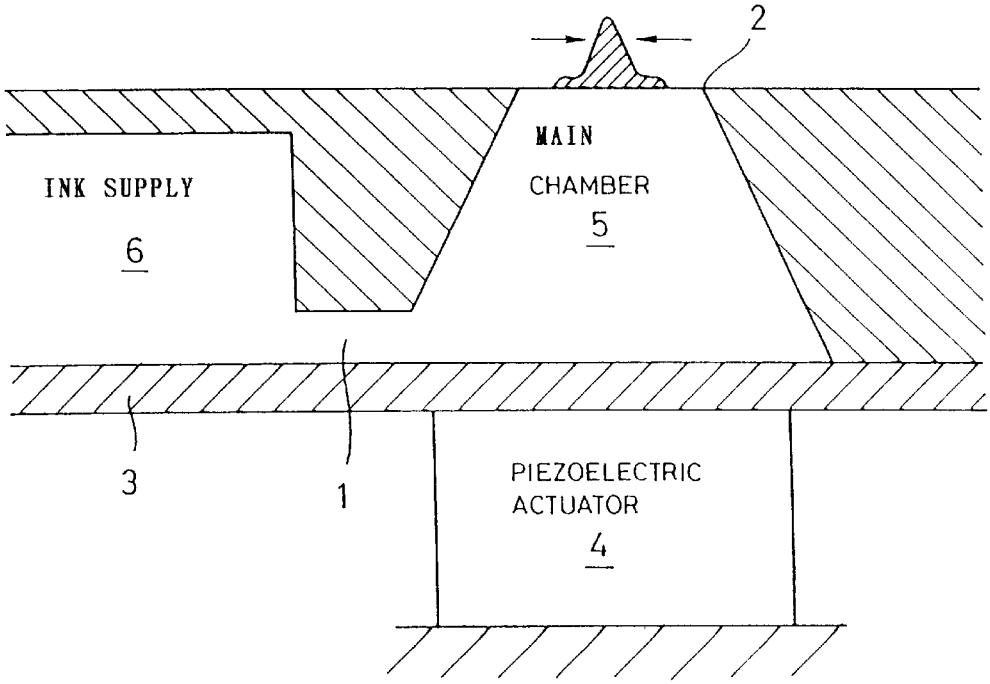
FIG. 2 is an illustration showing the droplet forming process of a droplet ejection apparatus in which an angle θ is set to 60° and a diameter D is set to 100 $\mu$m.
Figure 3:
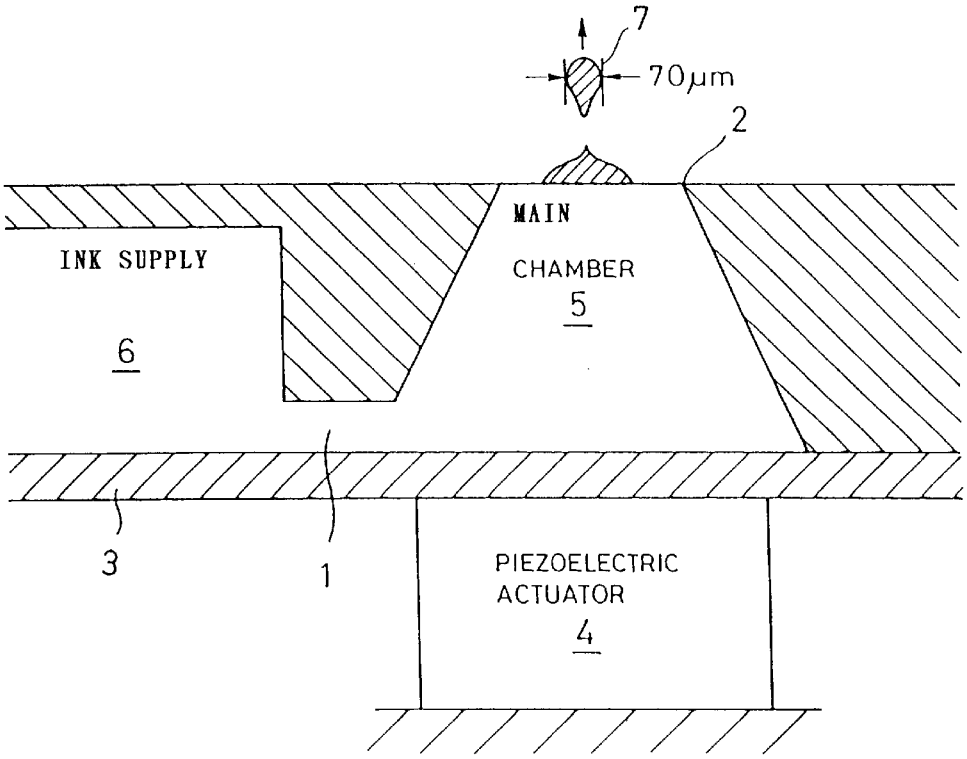
FIG. 3 is an illustration showing the droplet forming process of a droplet ejection apparatus in which an angle θ is set to 60° and a diameter D is set to 100 $\mu$m.

Hereafter, the process of determining the angle $\theta \leqq 65°$ and diameter $D \geqq 1.25 \times$droplet diameter is described below. To develop a practical apparatus for the droplet ejection apparatus of the older application, the present inventor et al. made the droplet ejection apparatus in which the angle θ is set to 60° and the diameter D is set to 100 μm shown in FIG. 1 and the droplet ejection apparatus in which the angle θ is set to 70° and the diameter D is set to 80 μm shown in FIG. 4 on an experimental basis. As shown in FIG. 1, the surface waves formed around the ejection aperture 2 due to a mechanical displacement of the pressurizing plate 3 driven by the piezoelectric actuator 4 are collected at the central portion of the ejection aperture 2 to form a liquid column as shown in FIG. 2. When the forming speed and the height of the liquid column reach the conditions enough to separate droplets, a droplet 7 separates as shown in FIG. 3. The diameter of the droplet 7 at the moment is approx. 70 μm and thus, a desired result can be obtained.

Figure 4:
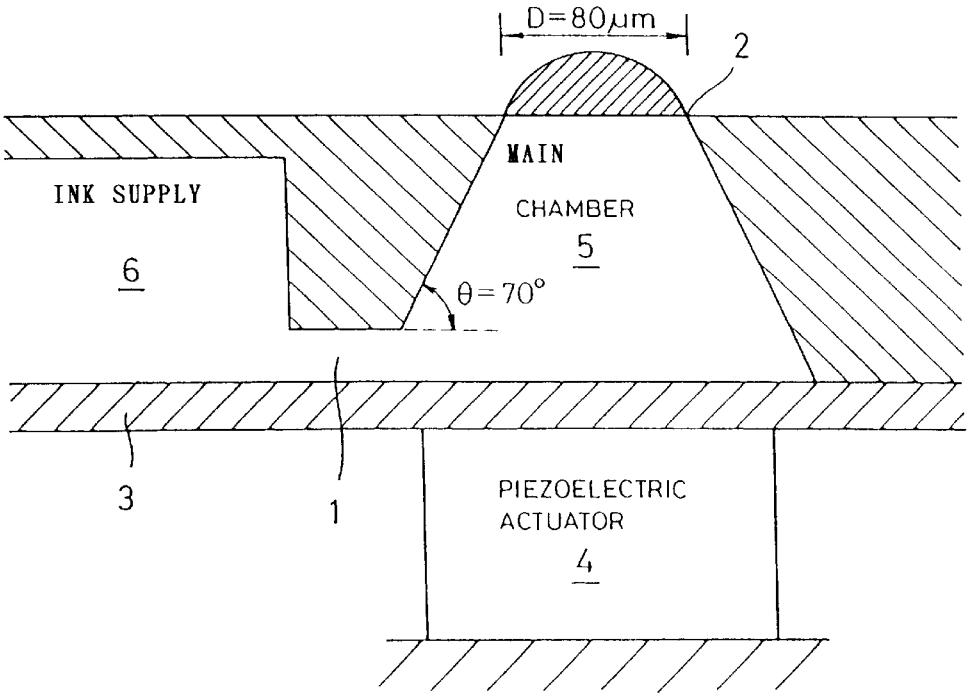
FIG. 4 is an illustration showing a prototype apparatus by which no desired result is obtained.
Figure 5:
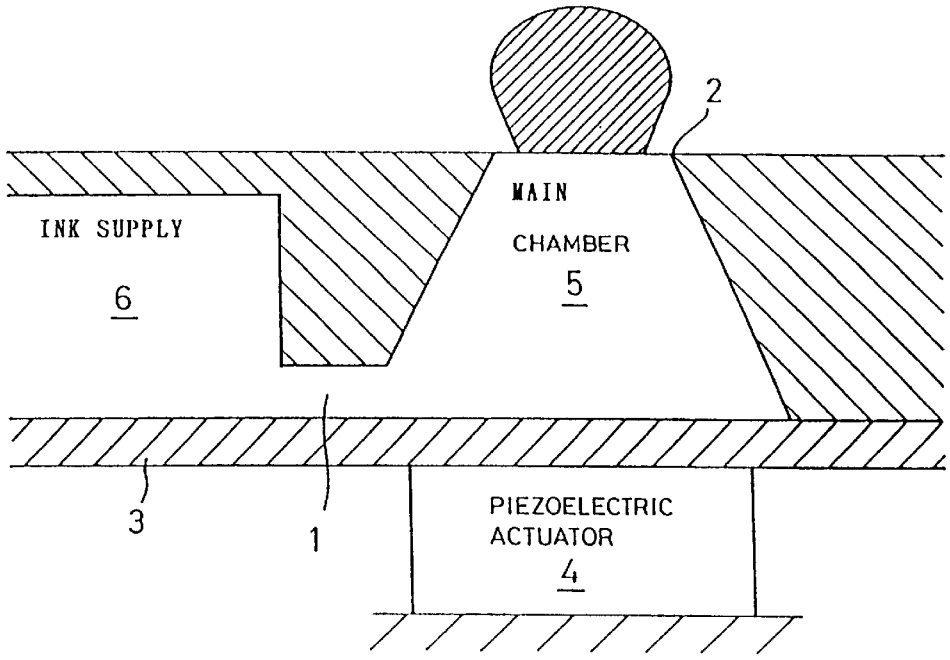
FIG. 5 is an illustration showing the droplet forming process of a droplet ejection apparatus in which an angle θ is set to 70° and a diameter D is set to 80 μm.
Figure 6:
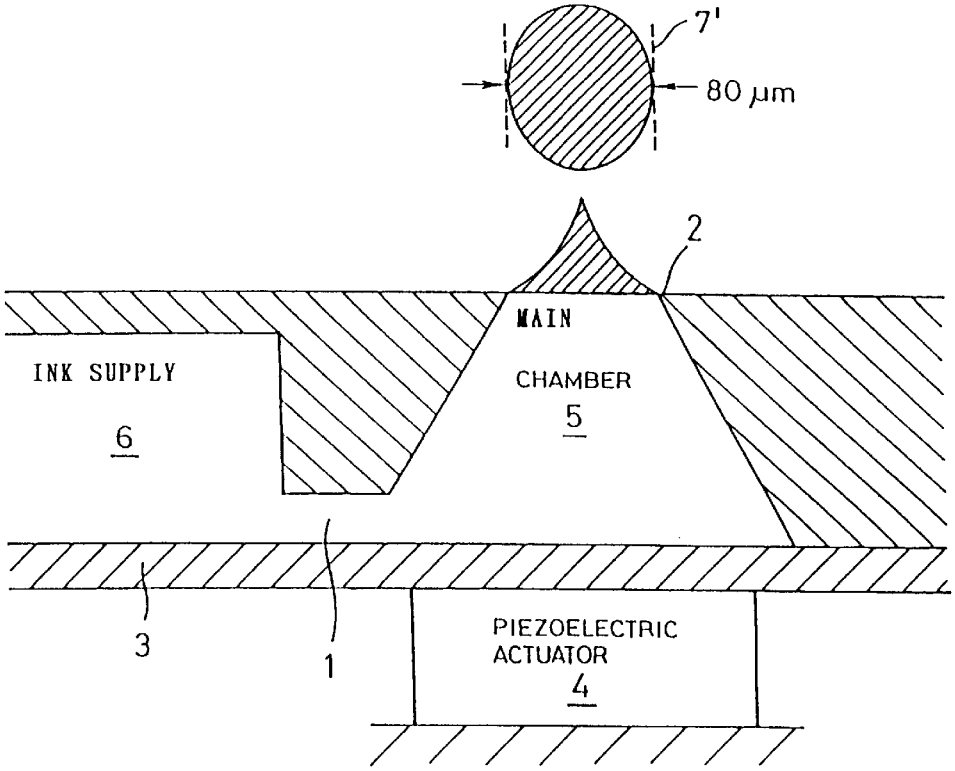
FIG. 6 is an illustration showing the droplet forming process of a droplet ejection apparatus in which an angle θ is set to 70° and a diameter D is set to 80 μm.

In the case of the droplet ejection apparatus shown in FIG. 4, all parameters (including a single pulse width to be applied to the piezoelectric actuator 4) other than the angle θ and the diameter D are set to the same conditions as the case of the droplet ejection apparatus shown in FIG. 1. As shown in FIG. 4, the surface of ink convexly swells due to the surface tension of the ink at the ejection aperture 2 because of the mechanical displacement of the vibration plate 3 driven by the piezoelectric actuator 4. In this case, presence of surface waves cannot be confirmed on the ink surface. As shown in FIG. 5, the swelled ink surface further forms a liquid column. When the forming speed and the height of the liquid column reach the conditions enough to separate a droplet, a droplet 7' separates as shown in FIG. 6. The diameter of the droplet 7' is 80 μm at the moment. The diameter of the droplet 7' is almost equal to the diameter D of the ejection aperture 2 but 70 μm which is a desired droplet diameter cannot be obtained.

Figure 7:
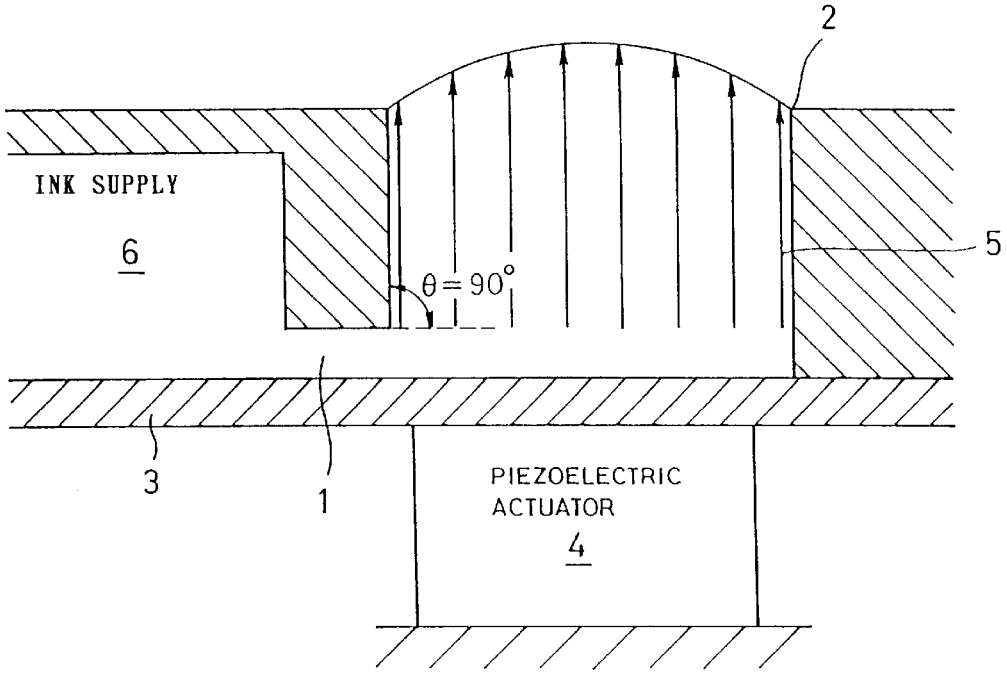
FIG. 7 is an illustration showing a droplet ejection apparatus having a chamber in which an angle θ is set to 90°.

According to the above results of prototypes, simulations were performed in accordance with various parameters. It was attempted to perform the simulation of a state when surface waves were formed on a computer system by inputting the parameters to the computer system. The following simulations were performed by bringing parameters (including the width of a single pulse to be applied to the piezoelectric actuator 4) other than the angle θ and the diameter D into the same condition. As shown in FIG. 7, when the angle θ is set to 90°, the pressure due to mechanical displacement of the pressurizing plate 3 serves as a force for uniformly swelling the ink in the main chamber 5 toward the ejection aperture 2 and therefore, it is impossible to form surface waves on the surface of the ink at the ejection aperture 2.

Under the above state in which surface waves cannot be formed on the ink surface, the process for forming the droplet 7' shown in FIGS. 4 to 6 is repeated but a desired result cannot be obtained.

Figure 8:
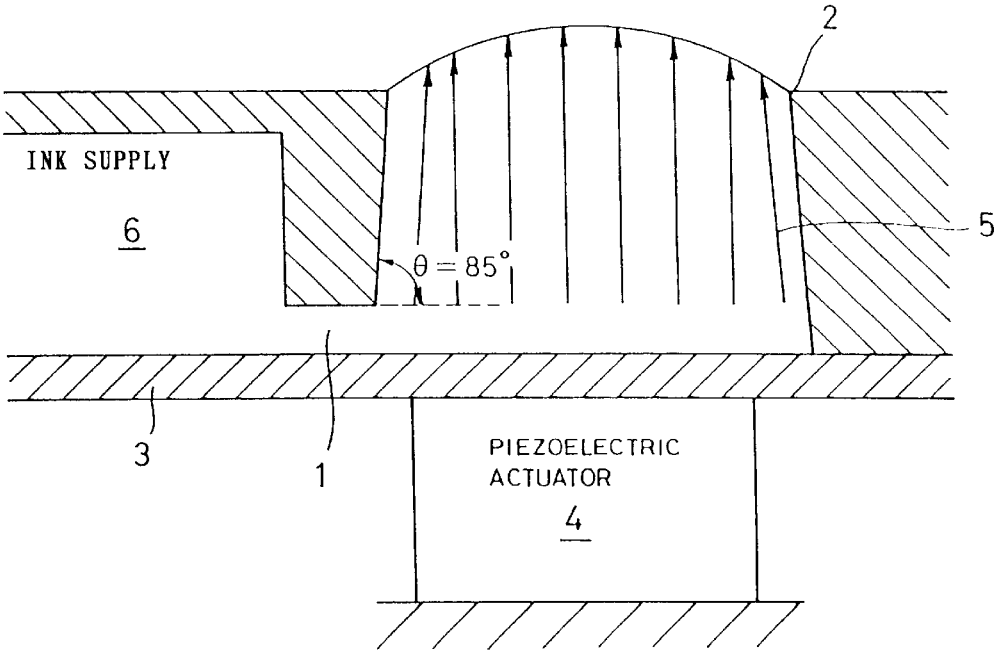
FIG. 8 is an illustration showing a droplet ejection apparatus having a chamber in which an angle θ is set to 85°.

The inventor et al. performed a simulation while decreasing the angle θ from 90°. As shown in FIG. 8, by decreasing the angle θ from 90°, the wall surface of the main chamber 5 forms a taper and the ink in the main chamber 5 closer to the wall surface increases in pressure and flow velocity due to mechanical displacement of the vibration plate 3.

Figure 9:
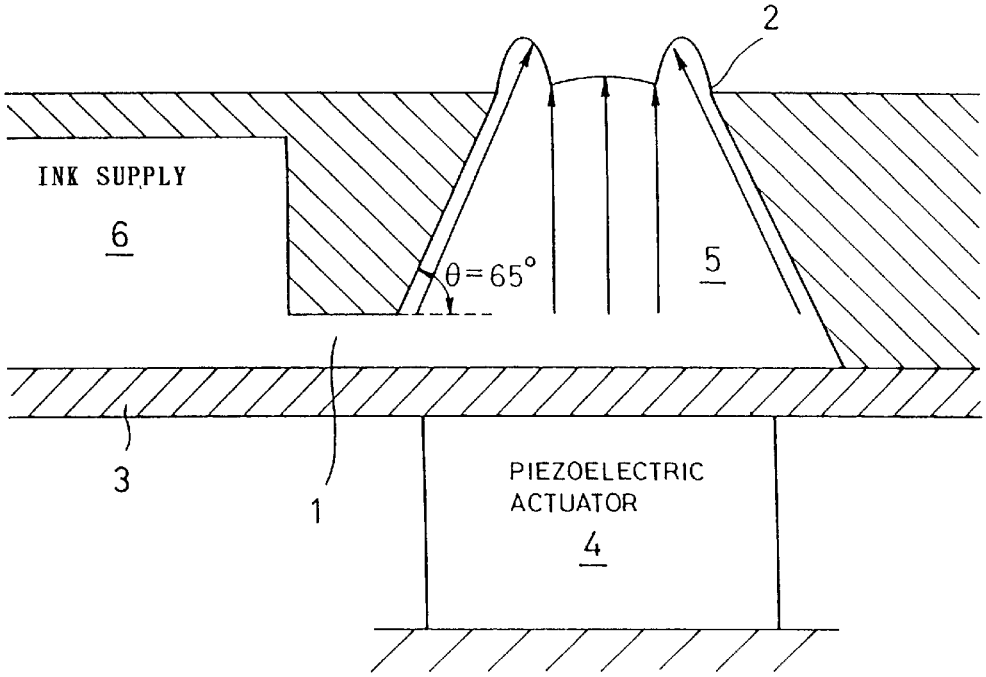
FIG. 9 is an illustration showing a droplet ejection apparatus having a chamber in which an angle θ is set to 65°.
Figure 10:
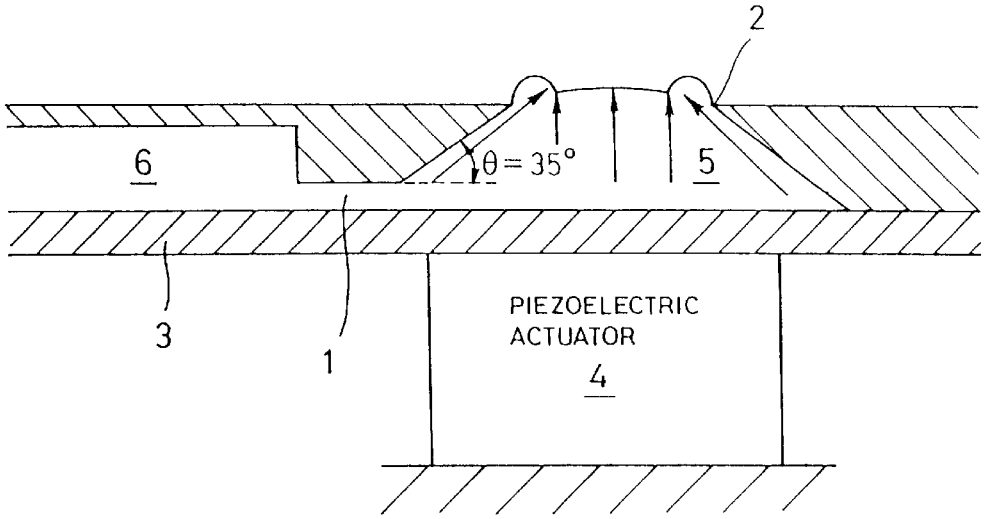
FIG. 10 is an illustration showing a droplet ejection apparatus having a chamber in which an angle θ is set to 35°.

When performing a simulation by setting the angle θ to 65° as shown in FIG. 9, formation of surface waves could be first confirmed. This shows that the taper of the wall surface of the main chamber 5 increased the pressure and flow velocity of the ink close to the wall surface up to values enough to form surface waves. Moreover, for motion of surface waves could be confirmed by performing a simulation by setting the angle θ to 35° as shown in FIG. 10. In this case, formation of surface waves could be confirmed from at the point of time when the angle θ falls below 65° even to the point of time when the angle θ becomes 35°.

Moreover, formation of surface waves could be confirmed through a simulation even when the angle θ becomes 35° or lower. However, it is considered practically proper to set the lower limit of the angle θ to 15° because it is necessary to reduce the capacity of the main chamber 5 or an ink supply 6 and there is a problem that the strength and stiffness nearby the ejection aperture 2 are decreased. Furthermore, to control the phenomenon that a liquid cylindrically protrudes and efficiently form surface waves for an applied pressure, it is preferable to set the angle θ from 15° to 60°.

Thus, when surface waves can be formed on the surface of an ink, it is possible to follow the forming process of the droplet 7 shown in FIGS. 1 to 3. Therefore, it is possible to obtain a desired result.

The following is the reason why it is proper that the diameter of the ejection aperture 2 is set to a value 1.25 or more times larger than the diameter of the droplet 7. In this case, the angle θ formed between the wall surface of the main chamber 5 and the plane vertical to the ejection direction of the droplet 7 is set to 60°. In this case shown in FIG. 11, surface waves formed on the surface of the ink at the ejection aperture 2 due to mechanical displacement of the vibration plate 3 driven by the piezoelectric actuator 4 are adjacent to each other because the diameter of the ejection aperture 2 is small. Therefore, they are attracted to each other due to the mutual surface tension.

Figure 11:
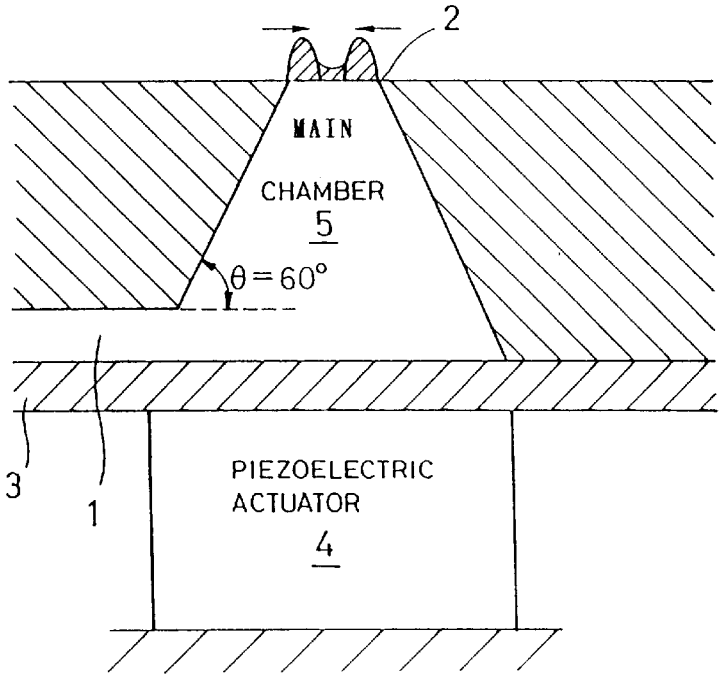
FIG. 11 is an illustration showing a surface-wave generation state of a droplet ejection apparatus in which a diameter D is smaller than 1.25 times the diameter of a droplet.
Figure 12:
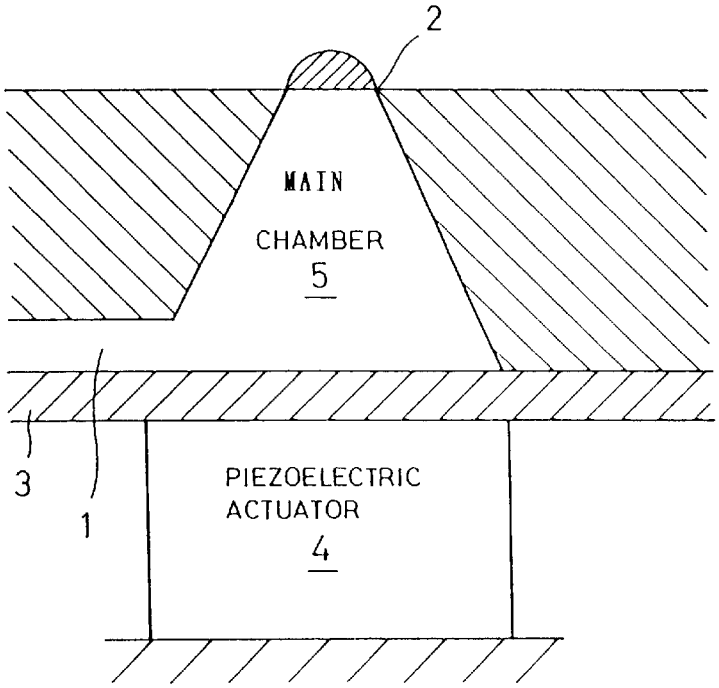
FIG. 12 is an illustration showing a surface-wave generation state of a droplet ejection apparatus in which a diameter D is smaller than 1.25 times the diameter of a droplet.

As shown in FIG. 11, surface waves attracted each other due to the mutual surface tension are united into one body without interfering with each other due to the mutual surface tension as shown in FIG. 12. Under the state shown in FIG. 11, though it seems as if surface waves are temporarily formed, the surface waves disappear before long. Therefore, as shown in FIG. 12, the ink surface convexly swells. The state shown in FIG. 12 is the same as the state shown in FIG. 4 and thereafter, the forming process of the droplet 7' shown in FIGS. 5 and 6 is repeated but a desired result cannot be obtained.

Thus, it is found that it is important for the surface waves formed on the ink surface at the ejection aperture 2 to keep a distance at which they are not attracted each other due to the mutual surface tension in order to eject droplets. Also in the case of this phenomenon, it is found that surface waves formed on the ink surface at the ejection aperture 2 are not attracted each other due to the mutual surface tension by using the ejection aperture 2 having a diameter 1.25 or more times larger than the diameter of a droplet as the result of a simulation by a computer system.

Thus, by using the ejection aperture 2 having such a size of diameter, the forming process of the droplet 7 shown in FIGS. 1 to 3 is repeated and a desired result can be obtained.

Because the droplet diameter in the case of the first embodiment of the first invention is approx. 70 μm, the diameter D of the injection aperture 2 is set to 100 μm. Moreover, when the diameter D of the injection aperture 2 is large, preferable surface waves are formed. When further increasing the diameter D, the cost for machining the ejection aperture 2 decreases. However, when increasing the diameter D, it must be considered that the distance from the adjacent ejection aperture 2 is restricted, more ink is evaporated, and formed surface waves attenuate when propagating on the surface. In the case of a practical structure, the upper limit of the diameter D is a value approx. three times larger than a desired maximum diameter of a droplet to be discharged.

The droplet ejection apparatus of the second embodiment of the first invention is described below by referring to FIGS. 13 and 14. It is already described that, by decreasing the angle θ of the wall surface in the main chamber 5 to less than 60°, most of the pressure applied to a liquid is used to form surface waves and the surface waves are efficiently formed. In this case, by decreasing the angle θ of the wall surface in the main chamber 5, strength and stiffness decrease because the wall thickness nearby the ejection aperture 2 decreases. Because of the decrease of the stiffness, the vicinity of the edge of the ejection aperture 2 is vertically displaced due to droplet ejection and the surface-wave forming efficiency lowers or droplet ejection becomes unstable. The second embodiment of this invention shows a case for compensating the decrease of the strength or stiffness. The second embodiment of this invention shows a case of setting the angle θ to 35°.

Figure 13:
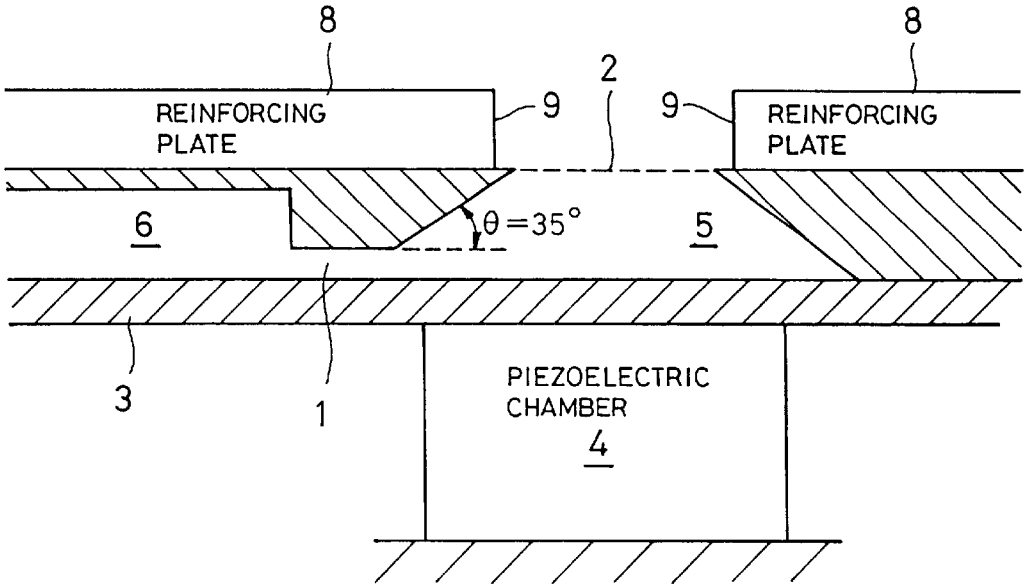
FIG. 13 is a schematic diagram of the droplet ejection apparatus of the second embodiment of the first invention.

According to the structure shown in FIG. 13, it is possible to restrain the displacement of the ejection aperture 2 by a reinforcing plate 8. Therefore, it is found that the surface-wave formation efficiency can be improved. It is necessary to form a second wall surface 9 formed with the reinforcing plate 8 so that the swell of liquid surface due to surface waves formed around the ejection aperture 2 is not attracted by the second wall surface 9 due to the surface tension of the liquid at the initial state of surface-wave formation. Therefore, in the case of the example shown in FIG. 13, the second wall surface 9 is formed so as to have a diameter slightly larger than the ejection aperture 2.

Figure 14:
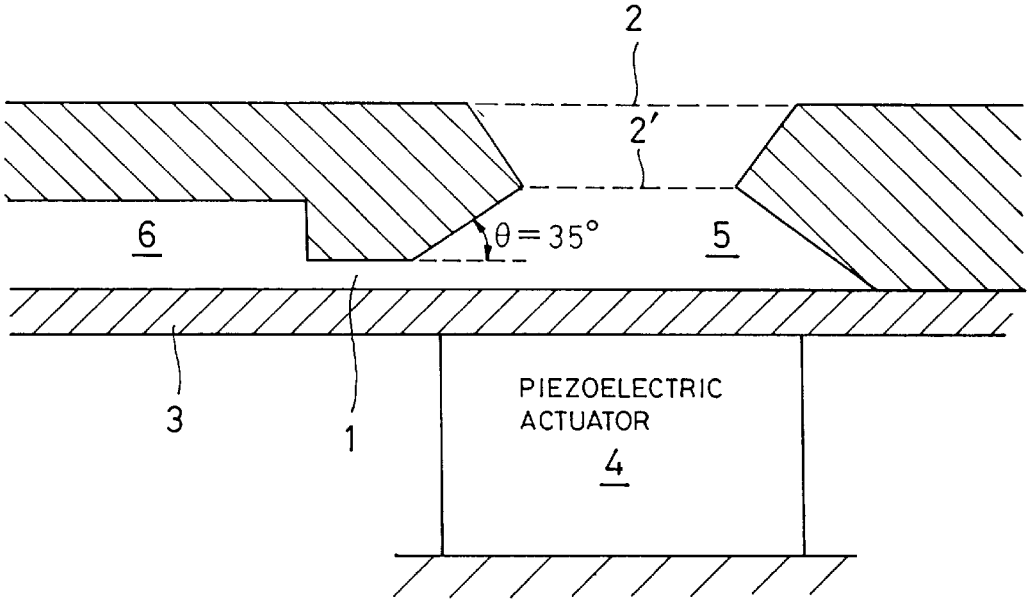
FIG. 14 is a schematic diagram of the droplet ejection apparatus of the second embodiment of the first invention.

Moreover, in the case of the example shown in FIG. 14, it is possible to form a practical ejection aperture 2' at a portion closer to the liquid surface than the ejection aperture 2 by machining a part of the wall surface of the main chamber 5 into a knife edge when machining the main chamber 5 and ejection aperture 2. By machining them as described above, the strength or stiffness of the practical ejection aperture 2' is not decreased even if the angle θ decreases. A part of the wall surface is formed into a knife edge so that the swell of the liquid surface due to surface waves formed around the practical ejection aperture 2' is not attracted by the wall surface due to the surface tension of the liquid as described above.

The first embodiment of the first invention is described by assuming a desired droplet diameter as 70 μm. However, by controlling a single pulse width to be applied to the piezoelectric actuator 4 of the droplet ejection apparatus shown in FIG. 1 so as to further decrease, it is possible to form the droplet 7 having a diameter smaller than 70 μm. Thereby, it is possible to realize a printing apparatus having a resolution of 300 dpi or more.

Moreover, though a droplet ejection apparatus is described as a printing apparatus for ejecting an ink droplet in the case of the second embodiment of the first invention, it is possible to use a liquid (e.g. dissolved indium) having a conductivity instead of the ink to form a bump (electrical contact) of a small electric circuit or integrated circuit. Furthermore, the droplet ejection apparatus of the first and the second embodiments of the first invention can be widely used as an apparatus for performing fine liquid droplet ejection.

The structure of the first embodiment of the second invention is described below by referring to FIG. 15.

The second invention is characterized by including a heater 15 serving as means for heating an injection liquid and a heat conducting plate 7 constituting the main chamber 5. The heater 15 includes a sensor 16 serving as means for keeping the temperature of an ejection liquid almost constant. The heat of the heater 15 is transmitted to the heat conducting plate 7 and thereby, the liquid is heated.

The heater 15 is set so that the temperature of an liquid is higher than a practical maximum temperature of an apparatus. The practical maximum temperature of the apparatus is set to 35° in the case of this invention.

Figure 16:
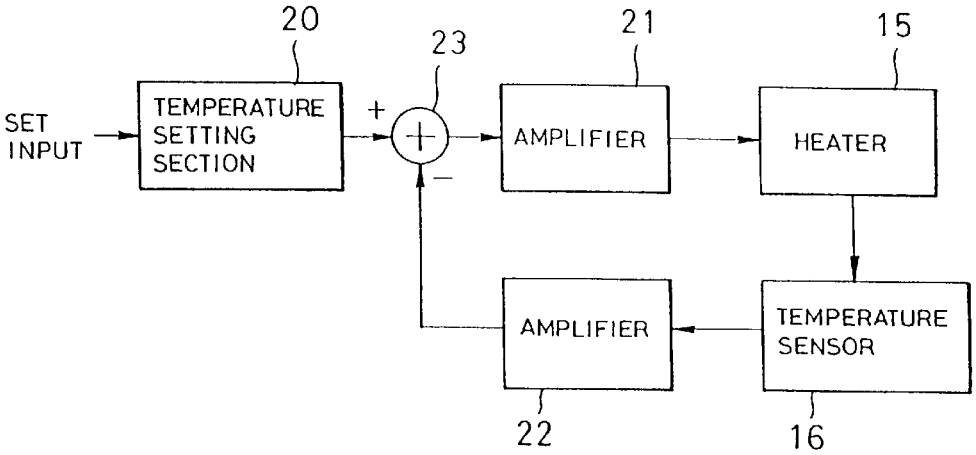
FIG. 16 is a block diagram showing the structure of a temperature regulating system.

With reference to FIG. 16, a voltage to be applied to the heater 15 is set to a temperature setting section 20 so that the heater 15 has a predetermined temperature. The value of the voltage is a voltage value obtained as the result of repeatedly performing experiments so that the heater 15 has a desired temperature by variously changing the voltage value.

The voltage output from the temperature setting section 20 is amplified by an amplifier 21 and supplied to the heater 15. When the heater 15 is heated, the heat conducting plate 7 shown in FIG. 15 is heated. The temperature sensor 16 is set onto the heat conducting plate 7 to detect the temperature of the heat conducting plate 7. The detection result is output as a voltage value and the voltage value is amplified by an amplifier 22. The voltage value is input to an adder 23. In the adder 23, the voltage value output from the temperature setting section 20 is added with the voltage value output from the amplifier 22. As a result, if the temperature of the heater 15 is higher than a set temperature, the voltage value output from the temperature setting section 20 is subtracted in the adder 23 and the temperature of the heater 15 lowers. However, when the temperature of the heater 15 is lower than the set temperature, the voltage value output from the temperature setting section 20 is hardly subtracted in the adder 23. Therefore, the heater 15 continues heating. Thereby, it is possible to keep the temperature of the heater 15 at the set temperature.

In the case of an embodiment of the second invention, only the heater 15 and temperature sensor 16 are illustrated but the temperature regulating system shown in FIG. 16 is not illustrated.

Figure 17:
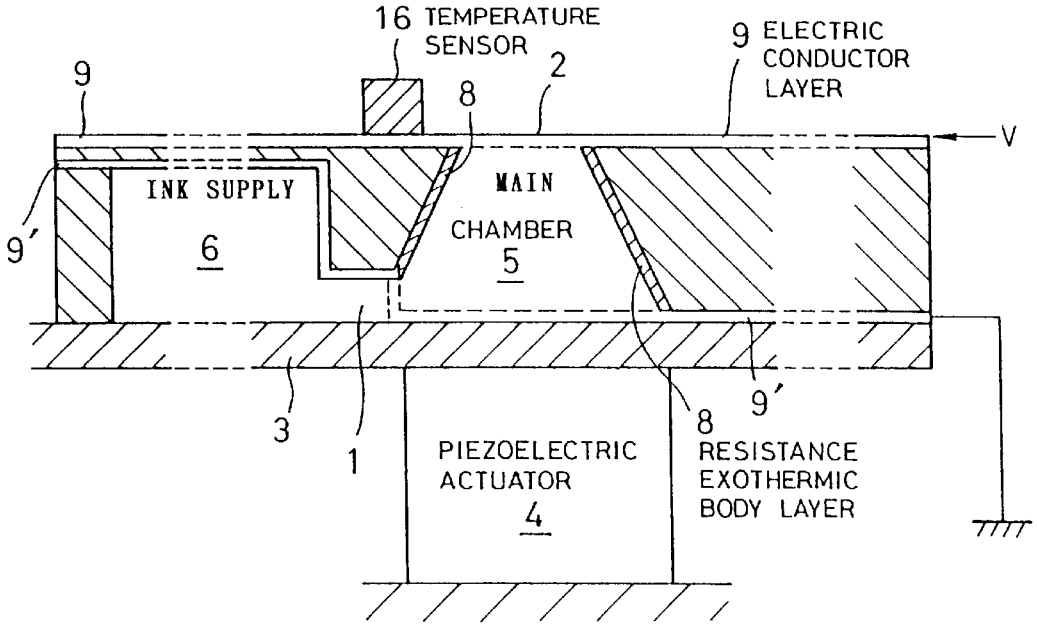
FIG. 17 is a schematic diagram of the droplet injection apparatus of the second embodiment of the second invention.

The second embodiment of the second invention is described below by referring to FIG. 17. The second embodiment of the second invention uses a resistance exothermic body layer 8 for the wall surface of an main chamber 5. A voltage is supplied to the resistance exothermic body layer 8 by an electric conductor layer 9 formed on a plane including an ejection aperture 2 and an electric conductor layer 9' formed on a plane including the bottom of the main chamber 5. The second embodiment of the second invention has an advantage of efficiently heating the inside of the main chamber 5 because it has a large heating area directly contacting a liquid.

Figure 18:
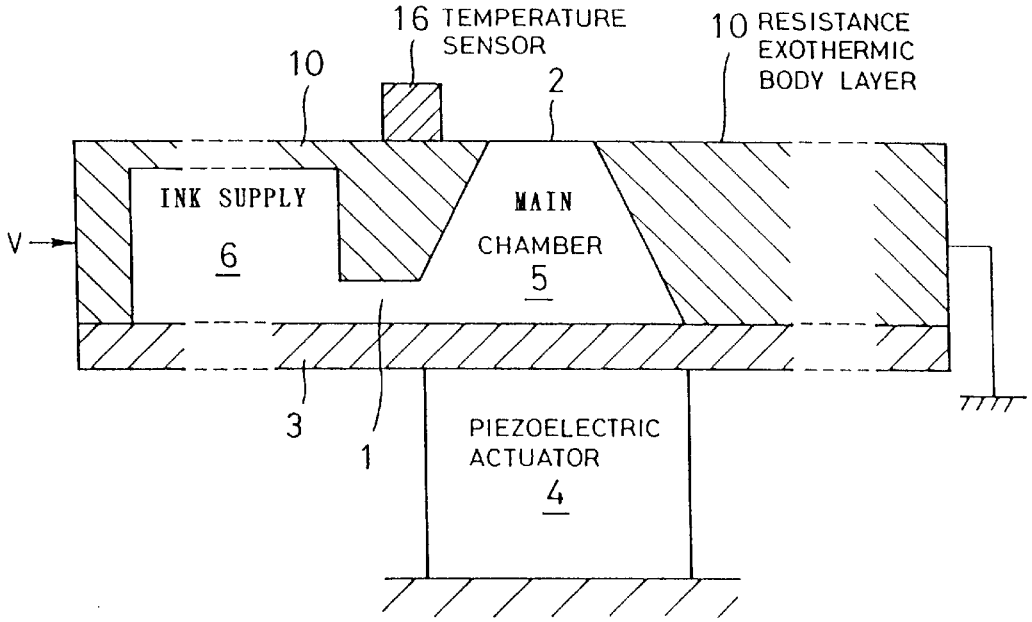
FIG. 18 is a schematic diagram of the droplet injection apparatus of the third embodiment of the second invention.

The third embodiment of the second invention is described below by referring to FIG. 18. The third embodiment of the second invention heats the liquid in an main chamber 5 and an ink supply 6 by using a plate for forming the main chamber 5 as a resistance exothermic body layer 10. Because the plate for forming the main chamber 5 can be machined as the resistance exothermic body layer 10 from the beginning, there is an advantage that the machining cost is not increased compared to the case of a structure having no heating means.

Figure 19:
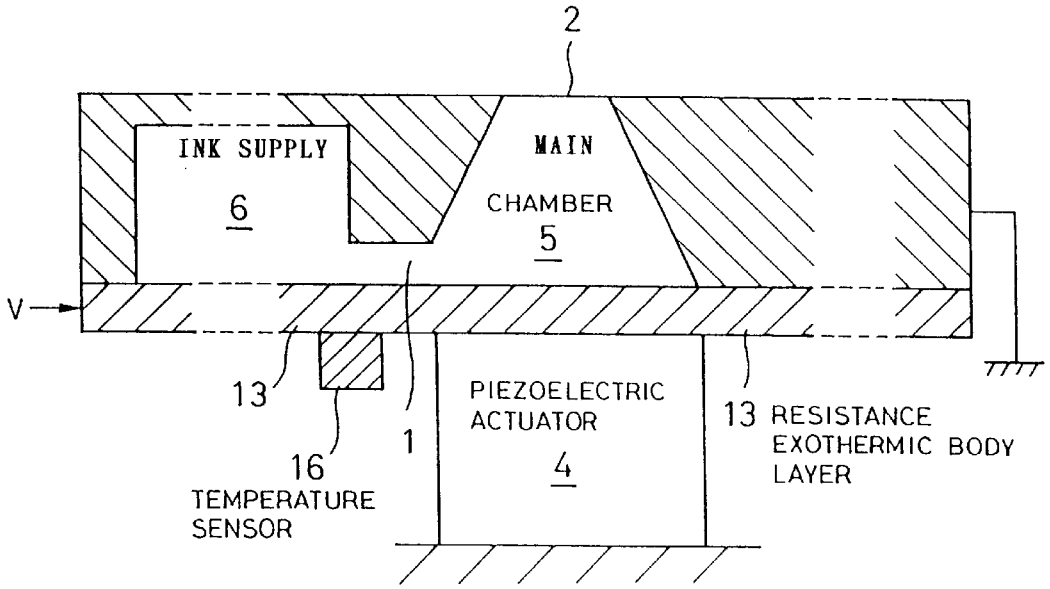
FIG. 19 is a schematic diagram of the droplet injection apparatus of the fourth embodiment of the second invention.

The fourth embodiment of the second invention is described below by referring to FIG. 19. The fourth embodiment of the second invention uses a vibration plate 3 as a resistance exothermic body layer 13. The pressurizing plate 3 is present at the bottom of an injection chamber 5. By using the pressurizing plate 3 as the resistance exothermic body layer 13, it is possible to efficiently heat the liquid in the main chamber 5 and an ink supply 6 because an area directly contacting the liquid is large.

Figure 20:
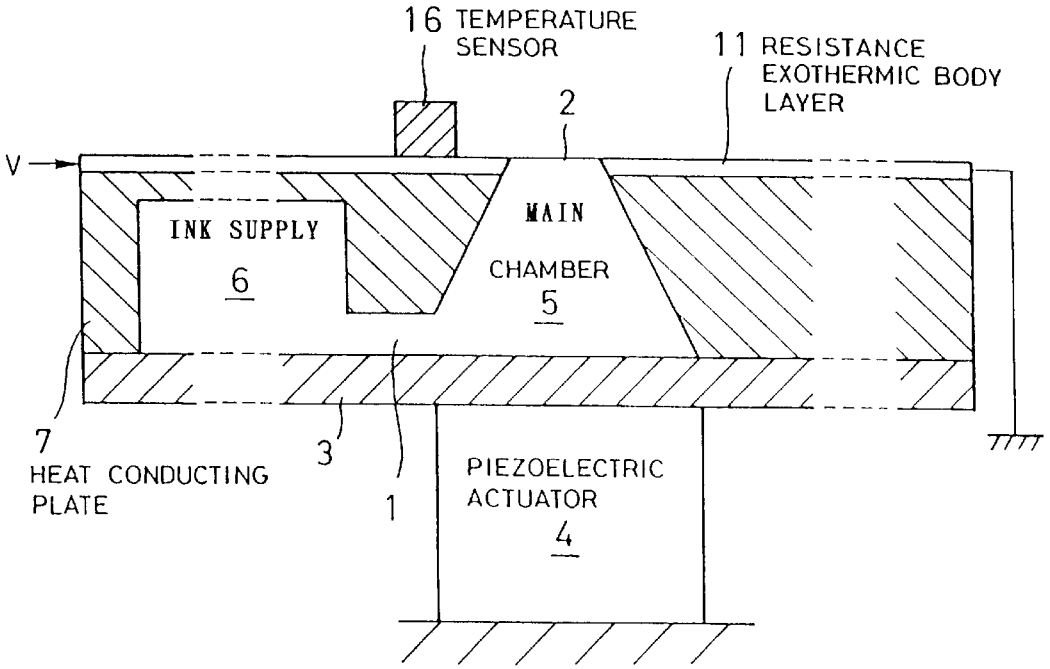
FIG. 20 is a schematic diagram of the droplet injection apparatus of the fifth embodiment of the second invention.

The fifth embodiment of the second invention is described below by referring to FIG. 20. The fifth embodiment of the second invention shows a case in which a resistance exothermic body layer 11 is formed on a plate including a main chamber 5. Though the heater 15 is provided for a part of the heat conducting plate 7 in the case of the first embodiment of the second invention, the resistance exothermic body layer 11 is provided for the whole of the heat conducting layer 7 in the case of the fifth embodiment of the second invention. Therefore, there is an advantage that the heating time until a desired temperature is obtained is short compared to the case of the first embodiment of the second invention.

Figure 21:
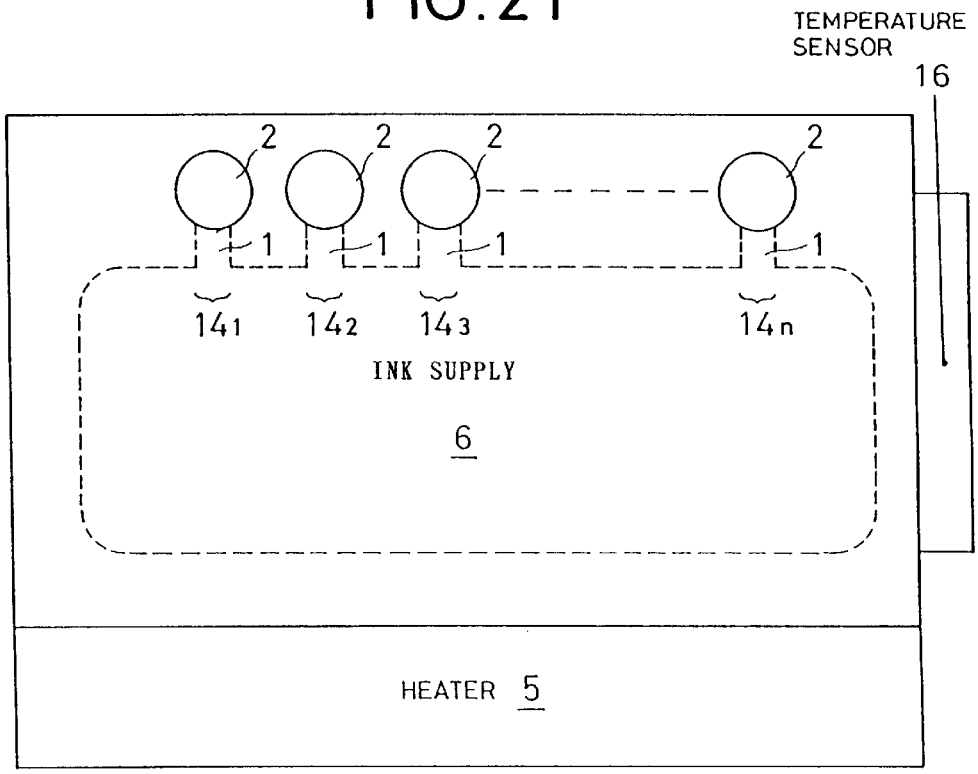
FIG. 21 is a schematic diagram of the typing and recording apparatus of the sixth embodiment of the second invention.

The sixth embodiment of the second invention is described below by referring to FIG. 21. In the case of the sixth embodiment of the second invention, a heater 15 is set to the head of the typing and recording apparatus constituted by using a plurality of droplet ejection apparatuses $\mathbf{14}_1$ to $\mathbf{14}_n$ to heat the liquid in main chambers 5 of the droplet ejection apparatuses $\mathbf{14}_1$ to $\mathbf{14}_n$ and the liquid in an ink supply 6. A heater 15 and a temperature sensor 16 are set to the outside of the frame one each. The sixth embodiment of the second invention has an advantage that it can be easily remodeled so that the temperature of a liquid can be regulated by adding the heater 15 and the temperature sensor 16 to the head of a printing apparatus having no heating means.

Figure 22:
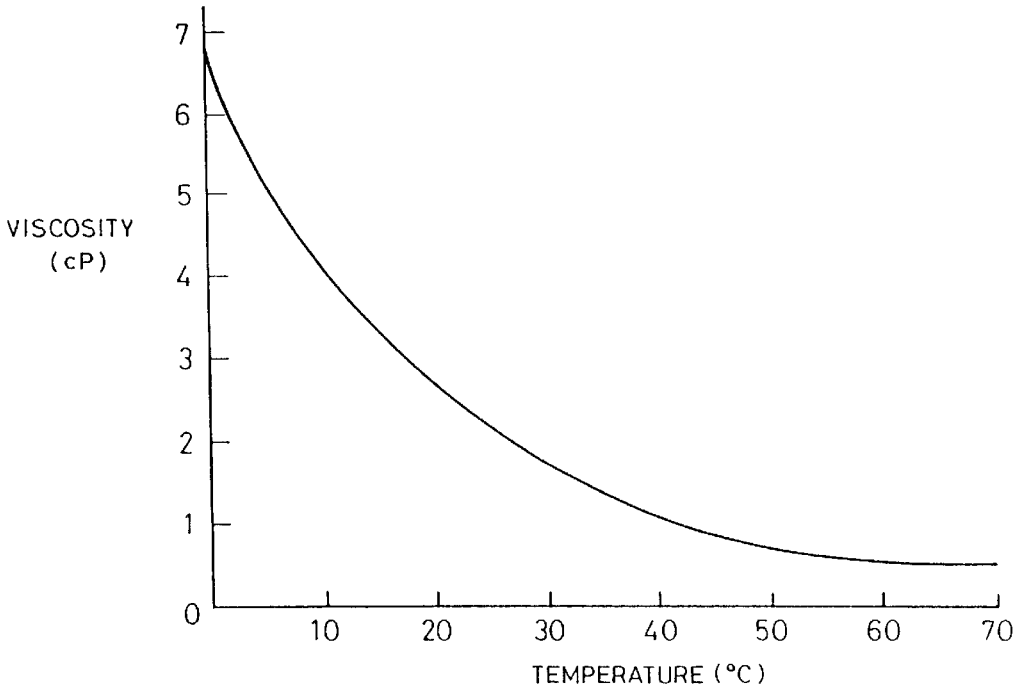
FIG. 22 is a diagram showing the relation between temperature and viscosity of a liquid.

With reference to FIG. 22, temperature (° C.) is assigned to the x-axis and viscosity (cP) is assigned to the y-axis. In the case of the droplet ejection apparatus of this embodiment of this invention, temperature is set to a value close to 55° C. because it is proper to keep the viscosity of a liquid to be injected at 0.8 cP in order to decide a desired droplet diameter.

Figure 23:
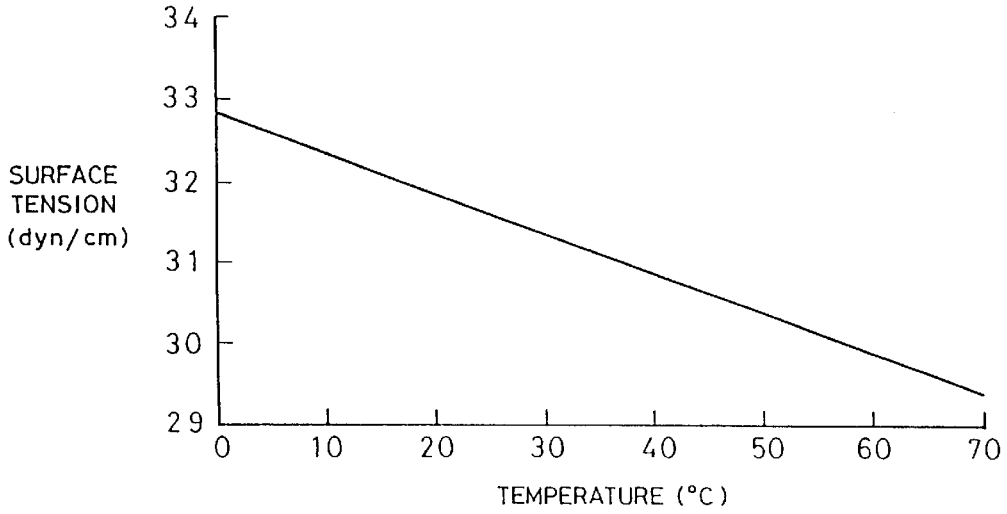
FIG. 23 is a diagram showing the relation between temperature and surface tension of a liquid.

With reference to FIG. 23, temperature (° C.) is assigned to the x-axis and surface tension (dyn/cm) is assigned to the y-axis. In the case of the droplet ejection apparatus of this embodiment of this invention, temperature is set to a value close to 55° C. because it is proper to keep the surface tension of a liquid to be ejected at 30 to 31 dyn/cm in order to decide a desired droplet diameter.

Figure 15:
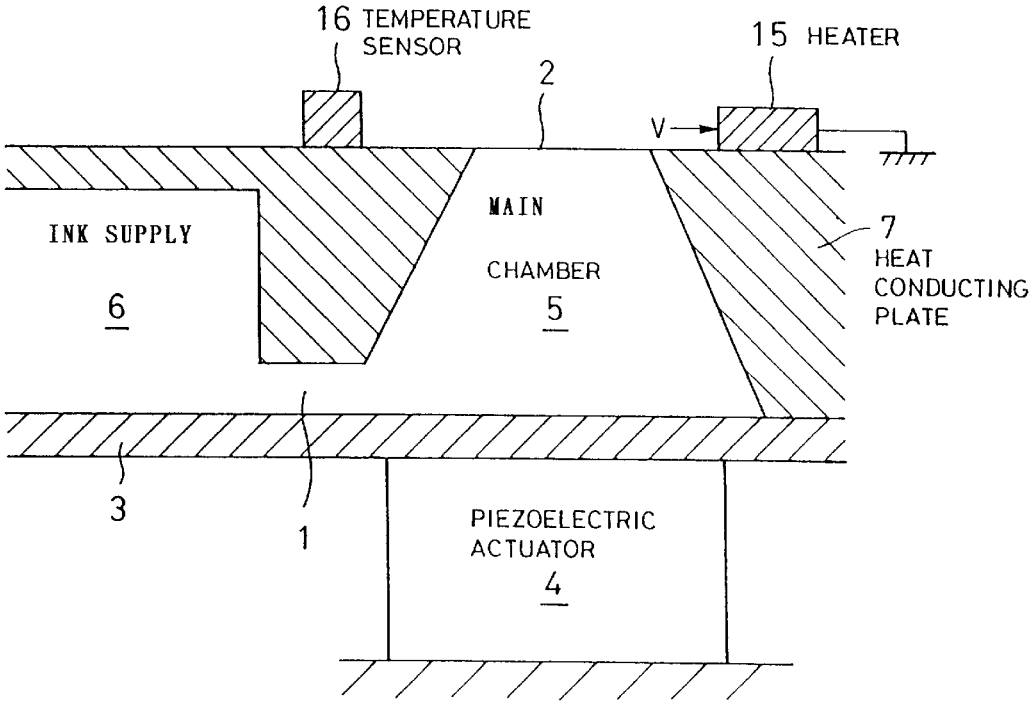
FIG. 15 is a schematic diagram of the apparatus of the first embodiment of the second invention.
Figure 41:
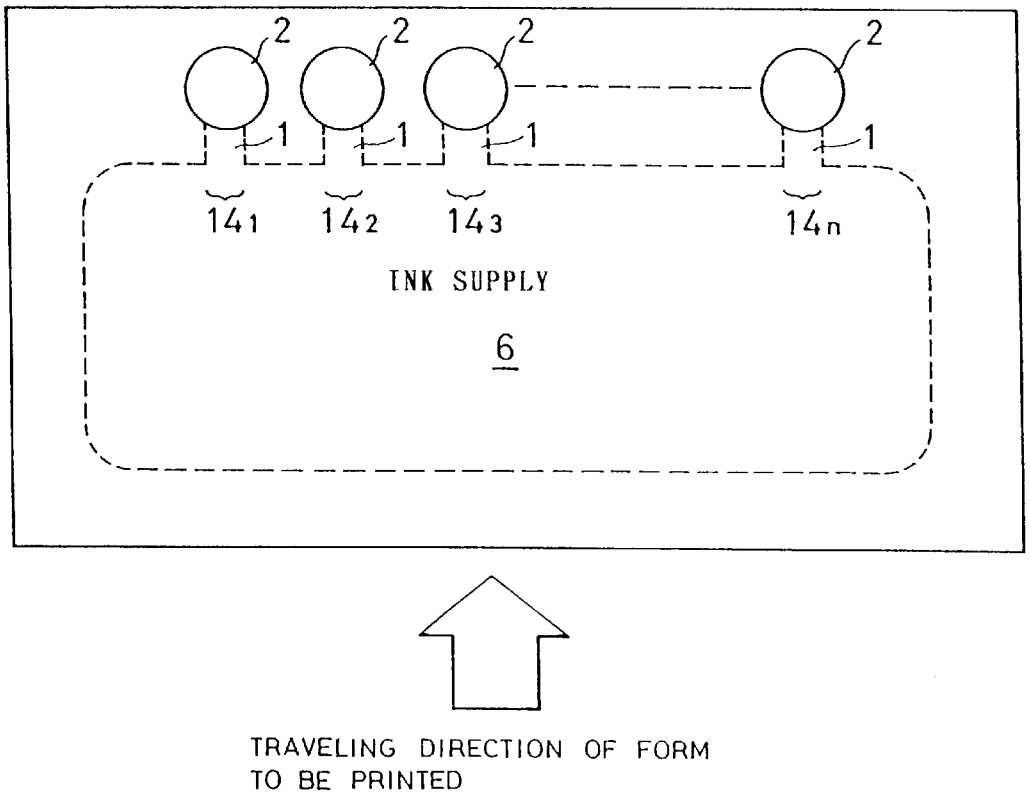
FIG. 41 is a schematic drawing for explaining the nozzle portion of a typing and recording apparatus provided with a plurality of droplet injection apparatuses.

The droplet ejection apparatus of an embodiment of the second invention shown in FIG. 15 is constituted as the head of the printing apparatus shown in FIG. 41 to perform a printing test. The ink used has the characteristics shown in FIGS. 22 and 23.

The temperature of the ink was set to 55° C.±2° C. In this case, room temperature was 25° C. A single sine-wave pulse was applied to the piezoelectric actuator 4. The pulse width is set to 50 $\mu$S. In this case, the sine-wave pulse represents a pulse waveform having a very narrow frequency distribution included in the pulse width.

As the result of performing a printing test according to the above structure and condition, it was possible to eject droplets having a diameter of 70 $\mu$m according to interference of surface waves. The diameter of 70 $\mu$m makes it possible to form a dot of 300 dpi on a printing medium.

Moreover, a printing test was performed together with a case in which ink had a room temperature of 25° C. without controlling temperature on trial. As a result, it was difficult to stably eject the ink droplet because the viscosity of the ink was too high, and too much energy was required.

The second invention makes it possible to provide a stable apparatus without greatly influencing the characteristic of droplet ejection even if operating environmental temperatures are changed.

Figure 24:
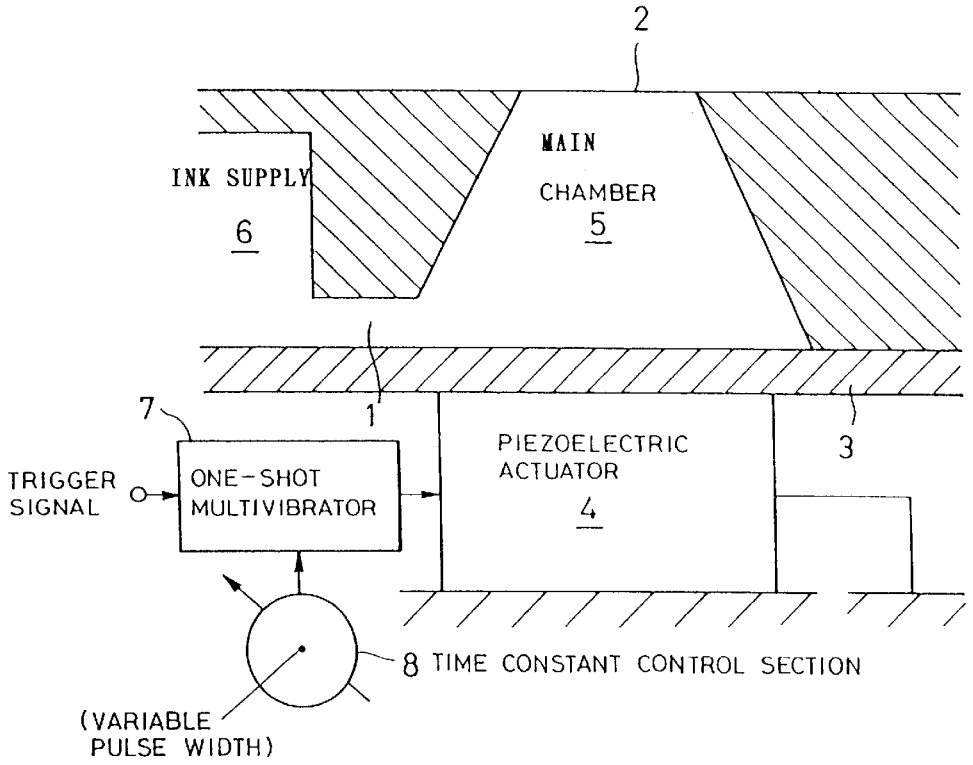
FIG. 24 is a schematic diagram of the apparatus of an embodiment of the third invention.
Figure 25:
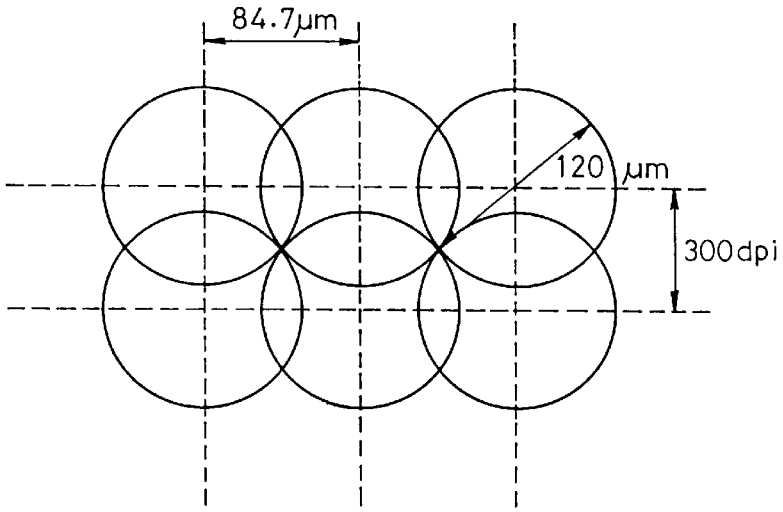
FIG. 25 is an illustration showing the dot diameter and dot pitch at a resolution of 300 dpi.

The structure of an embodiment of the third invention is described below by referring to FIG. 24.

The third invention is characterized in that a pulse to be applied to a piezoelectric actuator 4 for driving the vibration plate 3 is a single pulse having a pulse with "t" of 100 $\mu$S or less and more preferably, 50 $\mu$S or less. The pulse "t" represents a driving-voltage applying time which is equal to the time until the vibration plate 3 returns an liquid after it presses the liquid. The embodiment of this invention uses a one-shot multivibrator 7 capable of changing widths of a single pulse by a time-constant control section 8.

In the case of a printing apparatus, a resolution of at least 300 dpi and more is necessary from the viewpoint of image quality improvement and an ideal dot diameter on a chart at 300 dpi requires approx. square root of 2 times larger than the dot pitch of 84.7 $\mu$m and this value corresponds to approx. 120 $\mu$m . The relation between dot diameter and droplet diameter on a printing medium is changed due to the characteristic of a printing medium or the ejected droplet speed. In the case of the droplet ejection apparatus of the embodiment of the third invention, the ejection liquid speed is approx. 4 m/S because a printing ink is used. Therefore, to form a dot having a diameter of 120 $\mu$m on coated paper, it is necessary to discharge a droplet having a diameter of approx. 60 to 70 $\mu$m.

By using paper easily absorbing ink or decreasing a ejection droplet speed to 4 m/S or less, it is possible to further decrease the diameter of a droplet. In the case of the droplet ejection apparatus to eject droplets according to interference of surface waves of an embodiment of the third invention, however, an ejection liquid speed of approx. 4 m/S is suitable. Therefore, to print data on plain paper or coated paper at a resolution of 300 dpi or higher, it is necessary that a droplet having a diameter of at least 60 to 70 $\mu$m or less can be discharged.

In general, the ink used for a droplet ejection apparatus has a viscosity of 1.5 to 5 cP in the case of a water-based ink, 8 to 15 cP in the case of an oil-based ink, and 8 to 15 cP in the case of a hot-melt ink. Any one of these inks has a surface tension of 10 to 70 dyn/cm. A test was performed by using an ink having the above property. In this case, the diameter of the ejection aperture 2 of an apparatus used for the test is 100 $\mu$m and the cone angle of the wall surface from the plane vertical to the ejecting direction of the main chamber 5 is 60°. The test was performed at room temperature. The temperature of the ink was set to a value approx. 30° C. higher than the room temperature so that the ink was not easily influenced by an environment.

Figure 26:
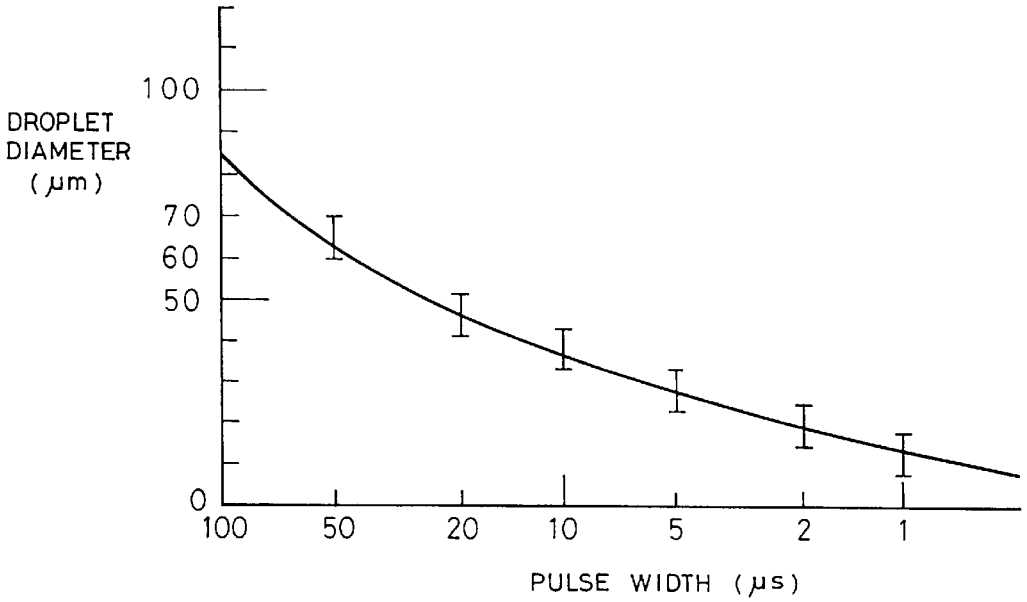
FIG. 26 is a diagram showing the relation between applying time "t" of a single pulse to be applied to the piezoelectric actuater and droplet diameter.

FIG. 26 shows the result of the above test. The waveform of the single pulse is almost sine-wave. The pulse width "t" is assigned to the x-axis and droplet diameter produced by the pulse is assigned to the y-axis. As a result, it is found that a droplet diameter of 60 to 70 $\mu$m is obtained when the pulse width "t" is 50 $\mu$S. Moreover, when an applying time "t" is 20 $\mu$s, a droplet diameter of 40 to 50 $\mu$m could be obtained. Furthermore, when the applying time "t" is 10 $\mu$s, a droplet diameter of 30 to 40 $\mu$m could be obtained, a droplet diameter of 25 to 30 $\mu$m could be obtained when the applying time "t" is 5 $\mu$s, a droplet diameter of 15 to 20 $\mu$m could be obtained when the applying time "t" is 2 $\mu$s, and a droplet diameter of 10 to 15 μm could be obtained when the applying time "t" is 1 μs.

Therefore, to realize a typing apparatus having a resolution of 300 dpi or higher, it is found that a pulse width "t" to be applied should be 100 μS or less and more preferably, a pulse width "t" of 50 μS or less is proper.

Moreover, by changing pulse widths, it is possible to change droplet diameters. That is, it is possible to control a dot diameter with a pulse width to be applied and realize continuous tone.

Figure 27:
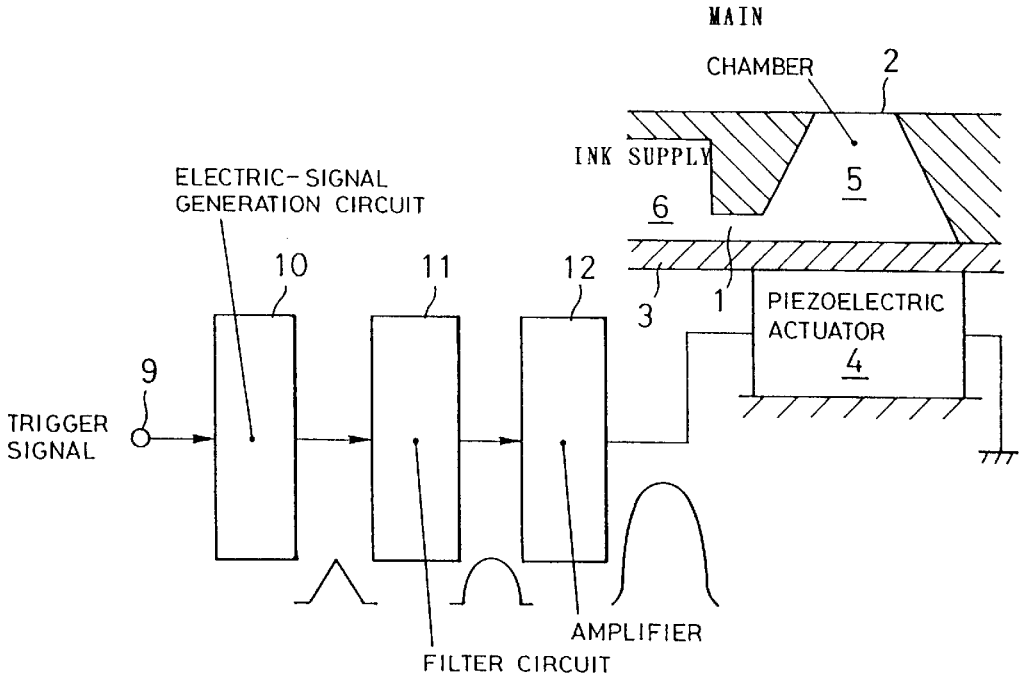
FIG. 27 is a block diagram of the apparatus of the first embodiment of the fourth invention.

The structure of the first embodiment of the fourth invention is described below by referring to FIG. 27.

The fourth invention is characterized in that a vibration plate 3 is provided with an electric-signal generation circuit 10 and a piezoelectric actuator 4 which is driven in accordance with an output of the electric-signal generation circuit 10 and whose mechanical displacement output is applied to the ejection liquid in the main chamber 5, in which a filter circuit 11 for selectively passing a sine-wave frequency component suited to form the surface waves is connected to a circuit between the output of the electric-signal generation circuit 10 and the piezoelectric actuator 4.

Figure 28:
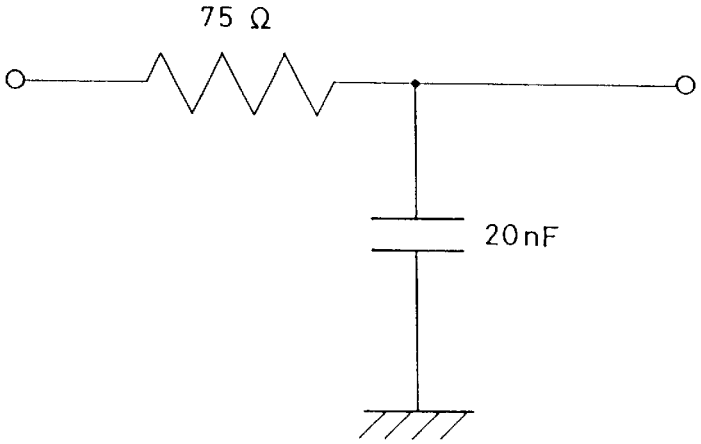
FIG. 28 is a circuit diagram of a filter circuit.

The electric-signal generation circuit 10 i s an inexpensive pulse generation circuit for generating a simple single pulse and its output frequency component is a multiple component. When observing a signal waveform output from the circuit, it looks like a triangular pulse. The electric-signal generation circuit 10 can be easily realized by a one-shot multivibrator. The filter circuit 11 is a low-pass filter. FIG. 28 shows a typical circuit diagram of the filter circuit 10. The low-pass filter is an example of using a simple and inexpensive CR filter. In FIG. 28, when assuming the frequency as "f", the following expression is obtained.

$$f=1/(2\pi CR)$$

Therefore, for example, f=100 kHz, R=75 Ω, and C≠20 nF are obtained.

Figure 29:
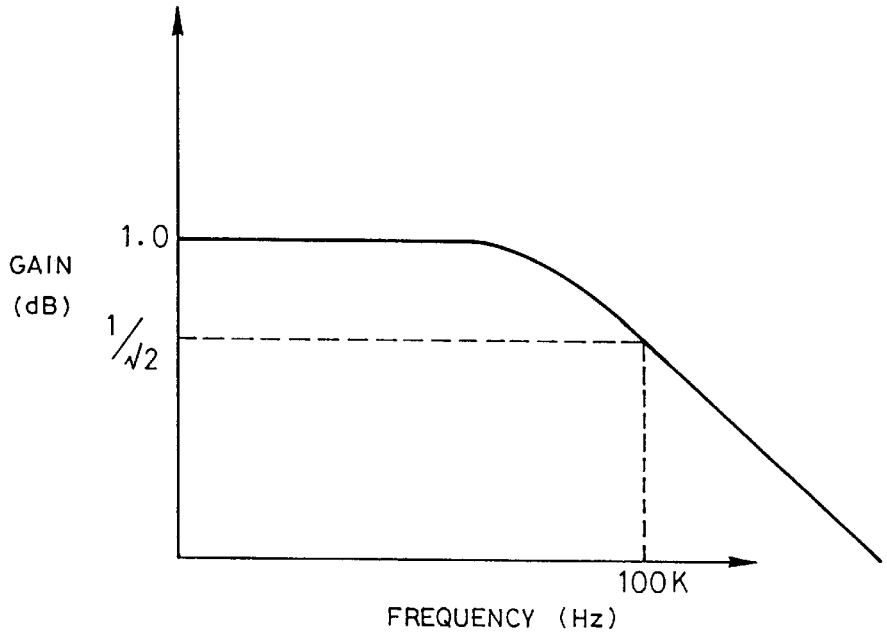
FIG. 29 is a diagram showing the characteristic of a low-pass filter of the filter circuit of the first embodiment of the fourth invention.

The diameter of the injection aperture 2 is approx. 100 μm and 10 μsec is selected as the pulse width of a driving signal to be supplied to the piezoelectric actuator 4. Therefore, 100 kHz which is a frequency corresponding to the pulse width is selected as the cutoff frequency of the filter circuit 11. In FIG. 29, frequency (Hz) is assigned to the x-axis and gain (dB) is assigned to the y-axis. As shown in FIG. 29, about 3 dB are attenuated for 100 kHz.

Operations of the first embodiment of the fourth invention are described below. A trigger signal for commanding injection of ink is input to an input terminal 9 from the injection aperture 2. The electric-signal generation circuit 10 receives the trigger signal to generate a pulse. This pulse apparently looks like a triangular pulse and includes various frequency components as described above. This pulse is input to the filter circuit 11 and only sine-wave components are made to pass. The filter circuit 11 is a low-pass filter using a simple CR filter. The amplitude (pulse height ) of the sine-wave pulse is amplified by an amplifier 12. This sine-wave pulse is converted into a mechanical displacement by the piezoelectric actuator 4. The mechanical displacement displaces the position of the vibration plate 3 and pressurizes the ink in the main chamber 5. The ink in the main chamber 5 is pressurized to form surface waves on the surface of the ejection aperture 2 in accordance with the theory disclosed in the old application and moreover described above and droplets are injected from the central portion where the surface waves converge.

As described above, the electric-signal generation circuit 10 obtains a sine-wave pulse by generating a proper pulse such as a triangular pulse and passing the triangular pulse through the filter circuit 11 comprising a low-pass filter. Therefore, it is possible to generate a sine-wave pulse by a simple and inexpensive circuit compared to the case of directly generating a sine-wave pulse by the electric-signal generation circuit 10.

Figure 30:
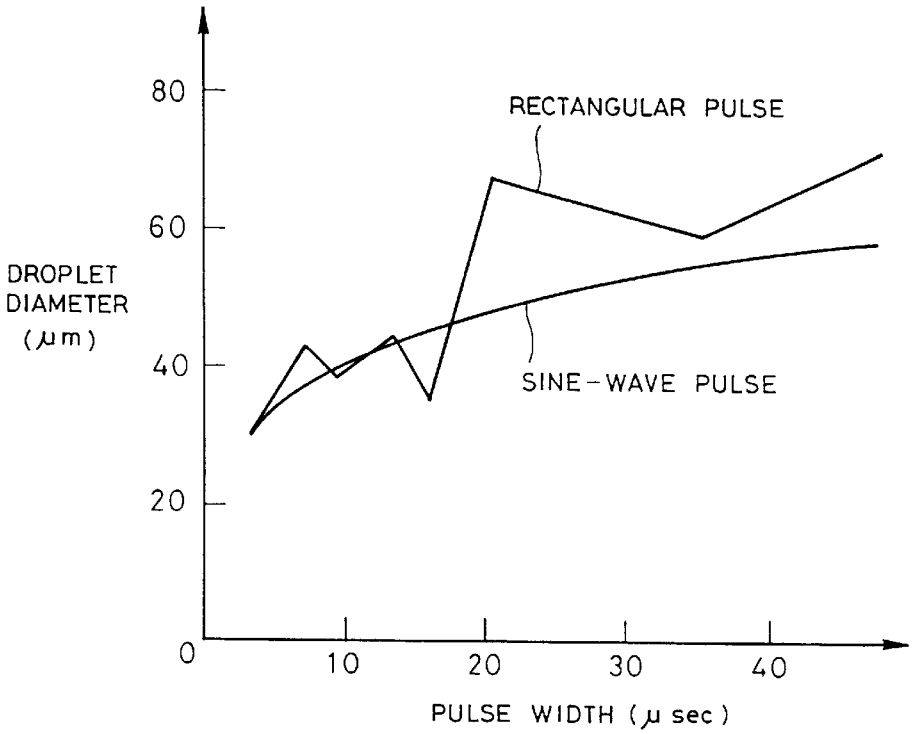
FIG. 30 is a diagram showing the relation between pulse width and droplet diameter.

Hereafter, the ground of obtaining the conclusion that a sine-wave pulse is most suitable as a driving waveform for the piezoelectric actuator 4 is described. In FIG. 30, pulse width (μsec) is assigned to the x-axis and droplet diameter (μm) is assigned to the y-axis. In this case, a sine-wave pulse is compared with a rectangular pulse. From FIG. 30, it is found that the rectangular pulse has a low controllability of a droplet diameter by a pulse width. This may be because the rectangular pulse has various frequency components and its influence is not simple and thus, a droplet diameter cannot be easily controlled.

Figure 31:
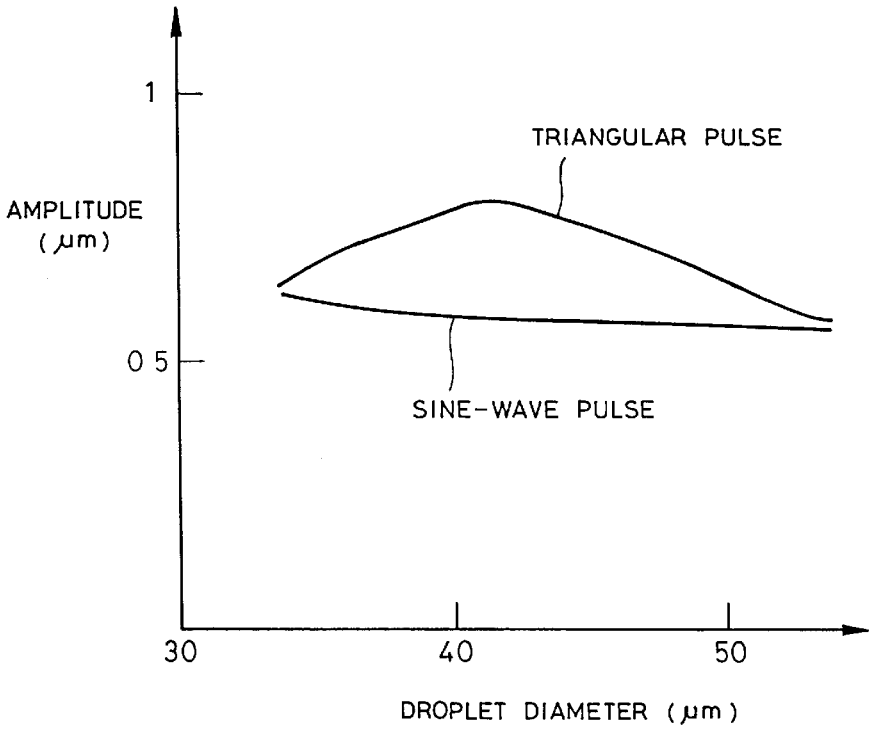
FIG. 31 is a diagram showing the relation between droplet diameter and necessary amplitude.

In FIG. 31, droplet diameter (μm) is assigned to the x-axis and amplitude (μm) is assigned to the y-axis. In this case, a sine-wave pulse is compared with a triangular pulse. From FIG. 31, it is found that the triangular pulse requires an input amplitude larger than that of the sine-wave pulse in order to form droplets of the same size. It is desired that the amplitude is lower when considering the loads on an actuator and its driving circuit. Therefore, it is found that the sine-wave pulse is more suitable than the triangular pulse as a driving waveform.

Figure 32:
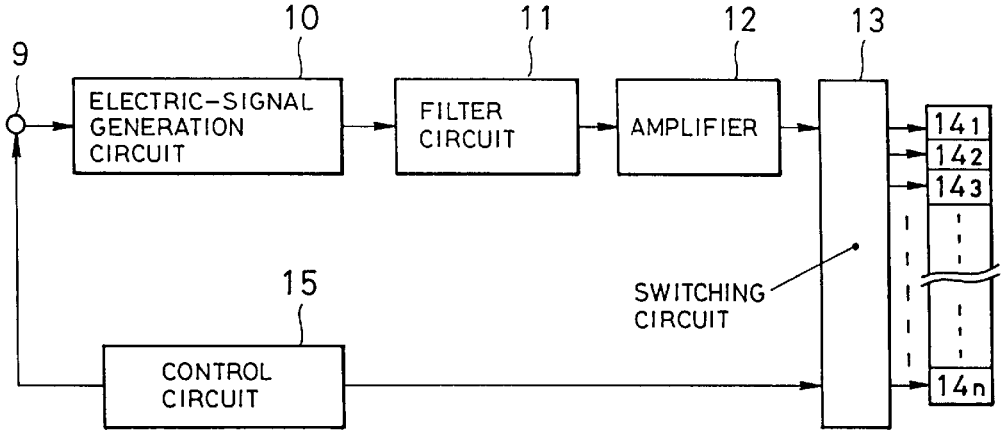
FIG. 32 is a block diagram of the apparatus of the first embodiment of the fourth invention.

With respect to FIG. 32, practically, a plurality of droplet injection apparatuses $\mathbf{14}_1$ to $\mathbf{14}_n$ are used and a sine-wave pulse appearing in an output of the amplifier 12 is supplied to a desired droplet injection apparatus 14*i* (i=1,2, . . . , n) by a switching circuit 13 controlled by a control circuit 15. Thereby, the apparatus of the first embodiment can be operated as a printing apparatus for drawing a desired character, numeral, figure, etc.

Figure 33:
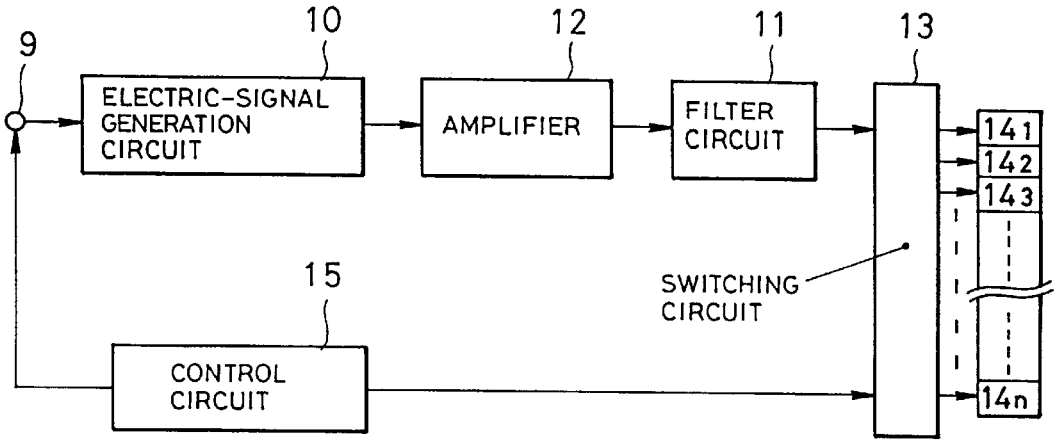
FIG. 33 is a block diagram of the apparatus of the second embodiment of the fourth invention.

The second embodiment of the fourth invention is described below by referring to FIG. 33. In the case of the second embodiment of the fourth invention, an amplifier 12 is connected between an electric-signal generation circuit 10 and a filter circuit 11. A triangular pulse generated by the electric-signal generation circuit 10 is amplified by the amplifier 12 and then, converted into a sine-wave pulse by the filter circuit 11. Thereby, it is possible to remove a harmonic distortion generated in the amplifier 12 by the filter circuit 11. Other operations are the same as those of the first embodiment of the fourth invention.

Figure 34:
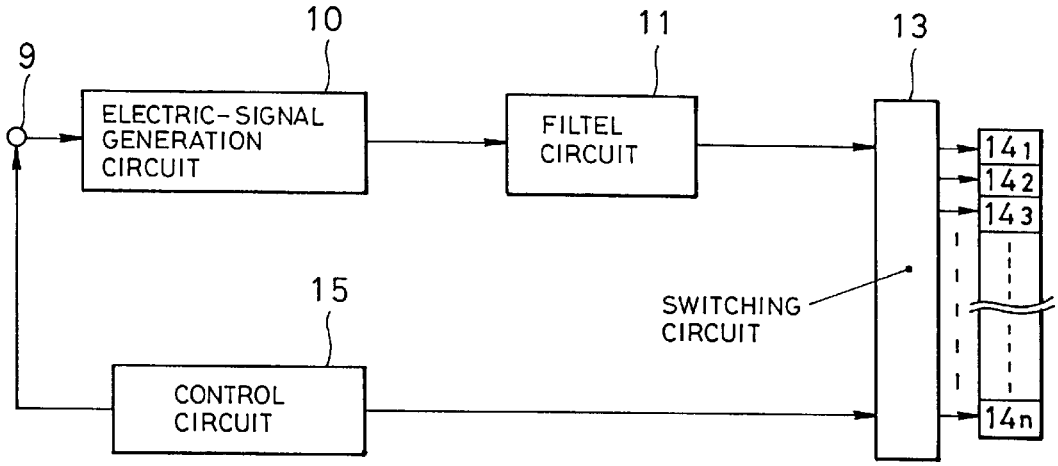
FIG. 34 is a block diagram of the apparatus of the third embodiment of the fourth invention.

The third embodiment of the fourth invention is described below by referring to FIG. 34. The third embodiment of the fourth invention has a structure obtained by excluding the amplifier 12 from the structures of the first and second embodiments of the fourth invention. It is possible to exclude the amplifier 12 by setting the amplitude of a triangular pulse output from the electric-signal generation circuit 10 to a value enough to drive the droplet ejection apparatuses $\mathbf{14}_1$ to $\mathbf{14}_n$.

In the case of the first to third embodiments of the fourth invention, it is described that the electric-signal generation circuit 10 is a one-shot multivibrator and its output waveform is a triangular pulse. However, it is also possible to obtain the same operation from a trapezoidal pulse or rectangular pulse in addition to the triangular pulse.

Figure 35:
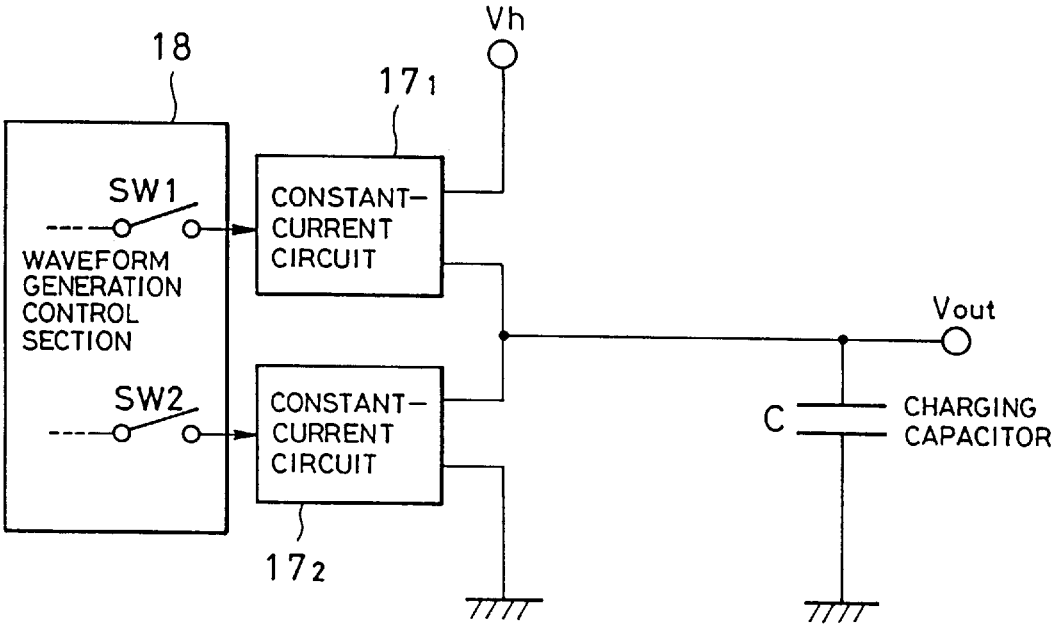
FIG. 35 is a block diagram showing an example of a circuit for generating a triangular pulse and a trapezoidal pulse.

The circuit shown in FIG. 35 makes it possible to generate a triangular pulse, trapezoidal pulse, or rectangular pulse because a waveform generation and control section 18 controls constant-current circuits $\mathbf{17}_1$ and $\mathbf{17}_2$.

Figure 36:
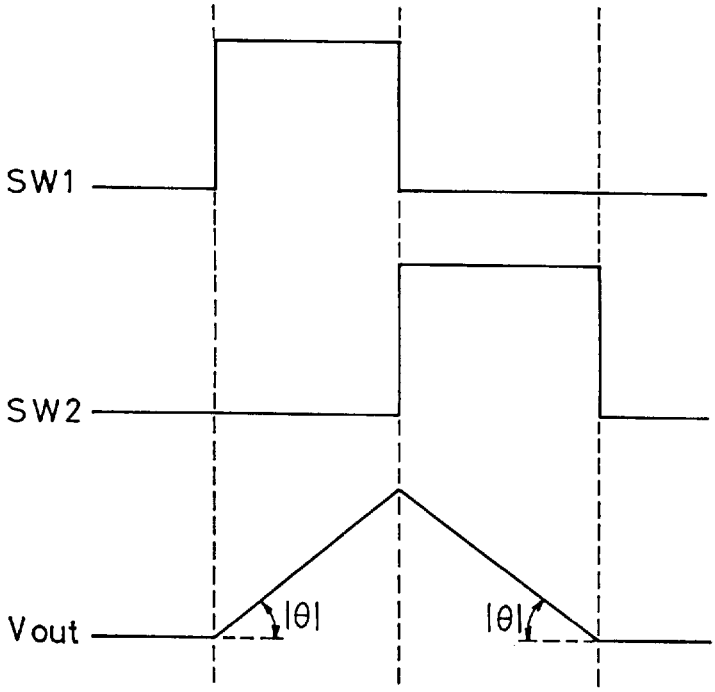
FIG. 36 is a signal diagram showing a triangular-pulse generation procedure.
Figure 37:
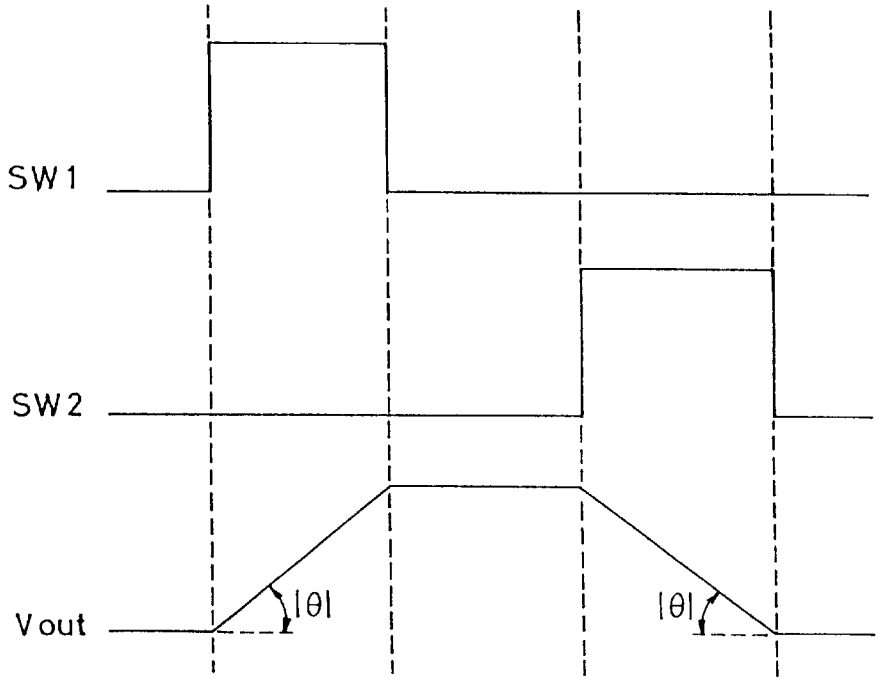
FIG. 37 is a signal diagram showing a trapezoidal-pulse generation procedure.

The waveform generation and control section 18 generates a triangular pulse by controlling switches SW1 and SW2 as shown in FIG. 36. Or, as shown in FIG. 37, the section 18 generates a trapezoidal pulse. By setting the time constant of a charging capacitor C to a proper value, it is possible to set the inclination θ of a triangular or trapezoidal pulse. Therefore, by removing the charging capacitor C, it is possible to generate a trapezoidal pulse. Moreover, the constant-current circuits $\mathbf{17}_1$ and $\mathbf{17}_2$ can be realized by a simple circuit using a transistor.

Thus, it is possible to generate a triangular, trapezoidal, and rectangular pulses with a simple inexpensive circuit. Therefore, obtaining sine-wave pulses by passing these pulses through a low-pass filter is effective to reduce the cost of t he apparatus and improve the reliability of the apparatus.

Figure 38:
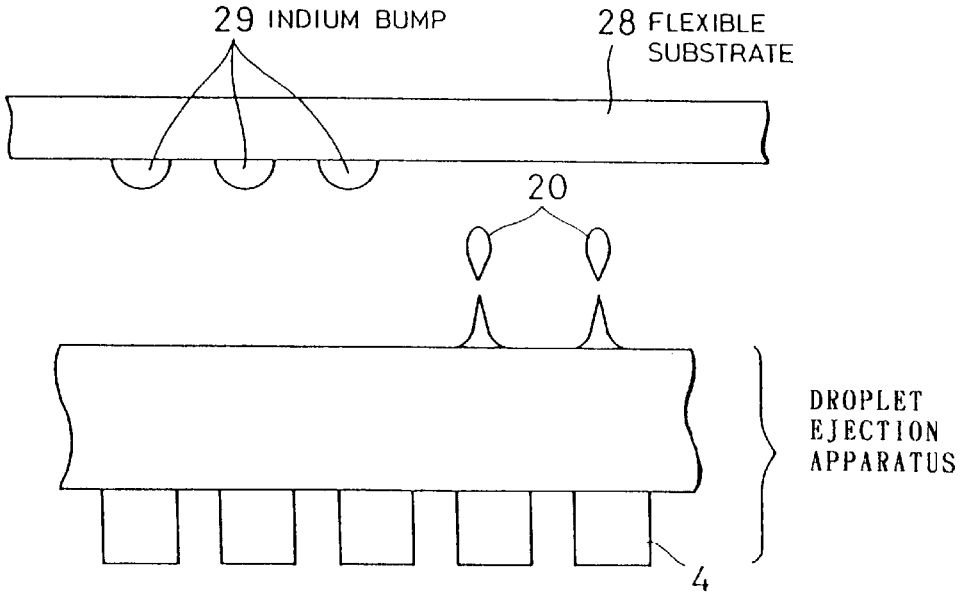
FIG. 38 is a conceptual view of the fifth embodiment of the fourth invention.
Figure 39:
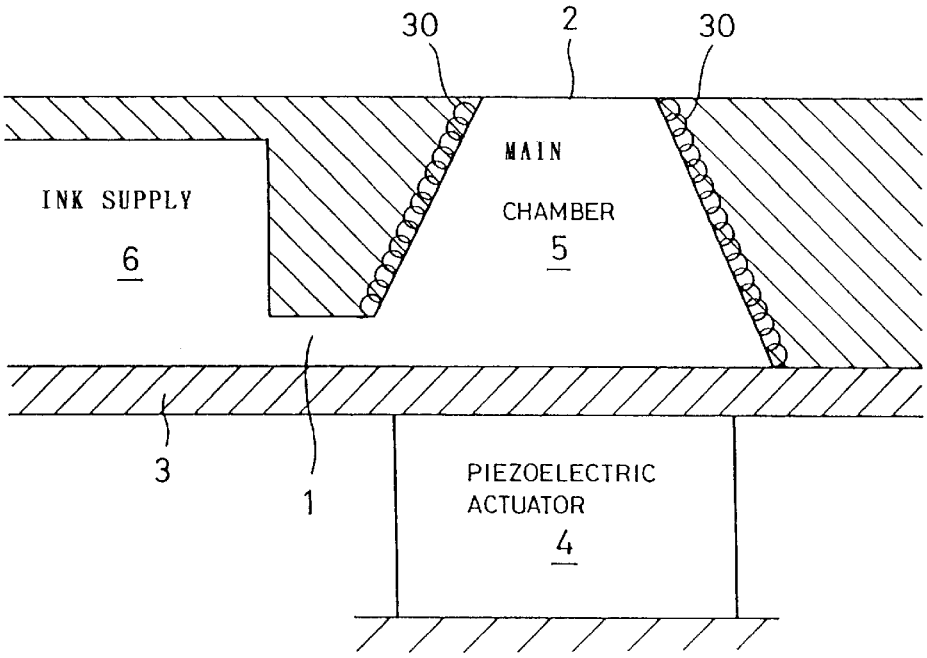
FIG. 39 is a schematic diagram of the droplet injection apparatus used for the fifth embodiment of the fourth invention.
Figure 40:
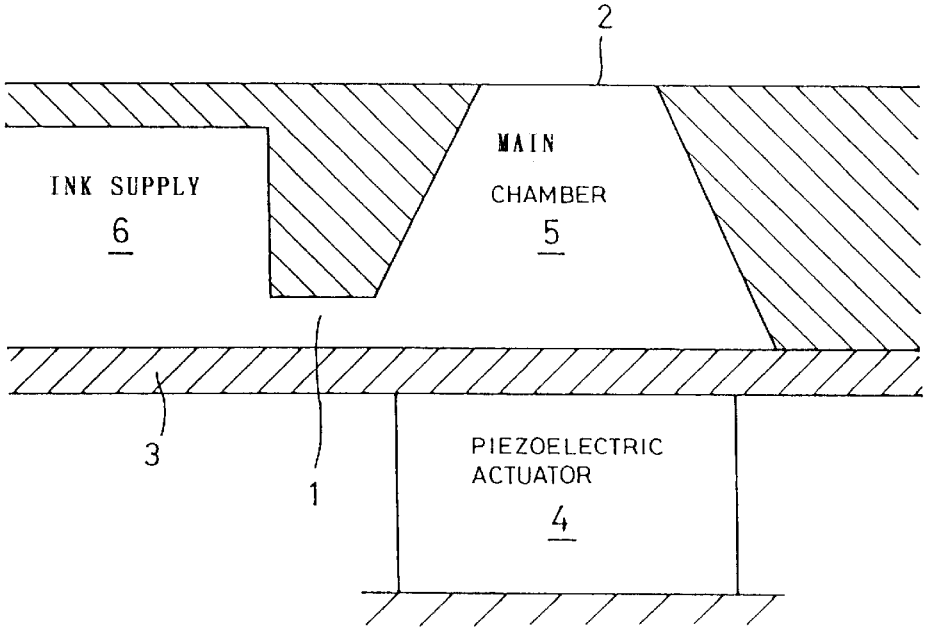
FIG. 40 is a schematic diagram showing the structure of a droplet ejection apparatus.

The fifth embodiment of the fourth invention is described below by referring to FIGS. 38 and 39. The fifth embodiment of the fourth invention shows a case of applying a droplet ejection apparatus of the fourth invention to an apparatus for forming a fine bump used for connection between semiconductors. The droplet ejection apparatus is constituted by setting a heater 30 to the inner wall of a main chamber 5 as shown in FIG. 39. The fifth embodiment of the fourth invention is described below by referring to FIG. 38. Indium having a melting point of approx. 110° C. was used as a liquid having a conductivity and it was attempted to form an indium bump 29 having a diameter of 50 μm at the front-end joint of a flexible substrate 28 formed at a pitch of 80 μm. As the result of heating the inside of the injection chamber 5 to approx. 125° C. by heater 30, providing a displacement with a displacement distance of 2.4 μm and a pulse width of 20 μsec for a piezoelectric actuator 4, and discharging droplets toward the flexible substrate 28, an indium bump 29 having a diameter of 50 μm could be formed at the joint. As the result of using the flexible substrate 28 with the indium bump 29 formed on it for the connection of a liquid crystal panel, it was confirmed that the substrate 28 completely functioned as a connecting bump and a high-reliability preferable connection was realized. The fifth embodiment of this invention shows a case of using indium as a bump material. However, it is also possible to use a metal having a low melting point such as solder or a bump material obtained by dispersing conductive particles of Au, Al, or Cu into a solvent.

As described above, the present invention makes it possible to realize a compact, handy, and high-resolution droplet injection apparatus. Moreover, because the present invention makes it possible to inject droplets having a diameter smaller than the diameter of an injection aperture, it is possible to lower the machining accuracy of the injection aperture and inexpensively manufacture the injection aperture. Furthermore, because the injection aperture is large, an ink is not easily hardened and defects due to clogging of ink are greatly decreased. Thus, the present invention makes it possible to inexpensively sell practical printing apparatuses having a resolution of 300 dpi or more in markets. Moreover, it is possible to realize a droplet injection apparatus which can be widely used as an apparatus for forming a conductive film of a small electric circuit or integrated circuit and performing fine printing.

What is claimed is:

1. A droplet ejection apparatus comprising a chamber having an ejection aperture and pressuring means for applying a pressure to liquid introduced into said chamber so as to eject droplets from said ejection aperture, wherein said chamber and ejection aperture are formed into a shape for ejecting a droplet having a diameter smaller than said ejection aperture, and said chamber has a circular or regular polygonal cross section taken in a plane perpendicular to an ejecting direction of said apparatus, said cross section expanding from said ejection aperture to a base portion of said chamber for forming surface waves on a surface of said liquid at the ejection aperture, wherein an angle formed between a wall surface of said chamber and said plane perpendicular to the ejecting direction is set to about 65° or less, and said ejection aperture has between about a 1.25 times and three times larger diameter than a droplet ejected from said ejection aperture.

2. The droplet ejection apparatus according to claim 1, wherein said angle is set to about 60° or less.

3. The droplet ejection apparatus according to claim 2, wherein said angle is set to 15° or more.

4. The droplet ejection apparatus according to claim 2, wherein said ejection aperture has a three or less times larger diameter than a droplet ejected from said ejection aperture.

5. The droplet ejection apparatus according to claim 1, wherein a wall surface of said chamber is formed into a knife edge such that, beginning at the knife edge, the cross section of said chamber expands beyond said ejection aperture in the ejecting direction to a second larger aperture.

6. The droplet ejection apparatus according to claim 1, wherein a reinforcing member for preventing the displacement of a wall surface of said chamber due to a pressure induced by said pressuring means is set around said ejection aperture.

7. The droplet injection apparatus according to claim 6, wherein said reinforcing member has an inner diameter larger than said ejection aperture.

8. The droplet ejection apparatus according to claim 1, wherein said ejection aperture has about a 1.25 times larger diameter than the droplet ejected from said ejection aperture.

9. A method of ejecting an ink droplet from a droplet ejection apparatus, comprising the steps of:

providing a chamber containing ink, and having an ejection aperture and pressuring means for applying a pressure to said ink so as to eject droplets from a surface of said ink at said ejection aperture, wherein said ejection aperture is formed into a shape for ejecting a droplet having a diameter smaller than said ejection aperture, and said chamber having a circular or regular polygonal cross section taken in a plane perpendicular to an ejecting direction of said apparatus, said cross section expanding from said ejection aperture to a base portion of said chamber for forming surface waves on the surface of said ink at said ejection aperture; and operating said pressuring means to eject a droplet of ink from said aperture, said droplet of ink being smaller than the diameter of said ejection aperture, by generating a surface wave on the surface of said ink at a peripheral part of said aperture and causing said surface wave to converge toward a center of the aperture corresponding to a fluid drop projecting point, so that only the surface wave that is generated at a peripheral part of the aperture causes said droplet of ink to project from the surface of said ink formed at aperture, wherein an angle formed between a wall surface of said chamber and said plane perpendicular to the ejecting direction is set to about 65° or less; and said ejection aperture has between about a 1.25 times and three times larger diameter than a droplet ejected from said aperture.

10. The method according to claim 9, wherein a wall surface of said chamber is formed into a knife edge to a knife edge such that, beginning at the knife edge, the cross section of said chamber expands beyond said ejection aperture in the ejecting direction to a second larger aperture.

11. The method according to claim 9, wherein a reinforcing member for preventing the displacement of a wall surface of said chamber due to a pressure induced by said pressuring means is set around said aperture.

12. The method according to claim 9, wherein said ejection aperture has about a 1.25 times larger diameter than the droplet ejected from said ejection aperture.

* * * * *